US007034276B2

(12) United States Patent
Morita

(10) Patent No.: US 7,034,276 B2
(45) Date of Patent: Apr. 25, 2006

(54) DRIVER CIRCUIT, ELECTRO-OPTICAL DEVICE, AND DRIVE METHOD

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 317 days.

(21) Appl. No.: 10/714,862

(22) Filed: Nov. 18, 2003

(65) Prior Publication Data

US 2004/0150599 A1 Aug. 5, 2004

(30) Foreign Application Priority Data

Nov. 21, 2002 (JP) ..... 2002-337908

(51) Int. Cl.
*H01J 40/14* (2006.01)

(52) U.S. Cl. ..... 250/214 R; 250/208.1

(58) Field of Classification Search ..... None
See application file for complete search history.

(56) References Cited

U.S. PATENT DOCUMENTS 6,566,643 B1 5/2003 Morita
6,650,462 B1 * 11/2003 Katase ..... 359/296

FOREIGN PATENT DOCUMENTS

JP A 4-052684 2/1992
JP A 8-334743 12/1996
JP A 10-319924 12/1998
JP A 11-338438 12/1999
JP A 2000-075841 3/2000
JP A 2002-175026 6/2002
JP A 2002-175035 6/2002
JP A 2003-114657 4/2003
JP A 2003-177722 6/2003

OTHER PUBLICATIONS

U.S. Appl. No. 10/714,872, filed Nov. 18, 2003, Morita.
U.S. Appl. No. 10/714,875, filed Nov. 18, 2003, Morita.

* cited by examiner

*Primary Examiner*—Que T. Le
(74) *Attorney, Agent, or Firm*—Oliff & Berridge, PLC

(57) ABSTRACT

A display panel has: a plurality of pixels; a plurality of scanning lines; a plurality of signal lines through each of which a multiplexed data signal for first to third color components is transmitted; and a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels. A gate signal generation circuit generates a shift clock signal based on the first to third demultiplex control signals, shifts a start pulse signal based on the shift clock signal to obtain a shift output, and outputs a signal corresponding to the shift output to one of the scanning lines.

12 Claims, 17 Drawing Sheets

DRIVER CIRCUIT, ELECTRO-OPTICAL DEVICE, AND DRIVE METHOD

Japanese Patent Application No. 2002-337908 filed on Nov. 21, 2002, is hereby incorporated by reference in its entirety.

BACKGROUND OF THE INVENTION

The present invention relates to a driver circuit, an electro-optical device, and a drive method.

A display panel (or an electro-optical device in a broad sense) represented by a liquid crystal display (LCD) panel is used as a display section of various information instruments. There has been a demand for reduction of the size and weight of the information instrument and an increase in the image quality. Therefore, reduction of the size of the display panel and reduction of the pixel size have been demanded. As one solution to satisfy such a demand, a method of forming a display panel by using a low temperature polysilicon (hereinafter abbreviated as "LTPS") process has been studied.

BRIEF SUMMARY OF THE INVENTION

According to a first aspect of the present invention, there is provided a driver circuit for driving an electro-optical device which has:

a plurality of pixels;

a plurality of scanning lines;

a plurality of signal lines through each of which a multiplexed data signal for first to third color components is transmitted; and a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels, the driver circuit comprising:

a gate signal generation circuit which generates a gate signal output to one of the scanning lines by using the first to third demultiplex control signals, wherein the gate signal generation circuit also generates a shift clock signal based on the first to third demultiplex control signals, shifts a start pulse signal based on the shift clock signal to obtain a shift output, and outputs a signal corresponding to the shift output to one of the scanning lines.

According to a second aspect of the present invention, there is provided a driver circuit for driving an electro-optical device which has:

a plurality of pixels;

a plurality of scanning lines;

a plurality of signal lines through each of which a multiplexed data signal for first to third color components is transmitted; and a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels, the driver circuit comprising:

a gate signal generation circuit which generates a shift clock signal based on an input shift clock signal, shifts a start pulse signal based on the shift clock signal to obtain a shift output, and outputs a signal corresponding to the shift output to one of the scanning lines, wherein the gate signal generation circuit includes:

a shift clock generation circuit which generates the shift clock signal by dividing a frequency of the input shift clock signal into three; and a demultiplex control signal generation circuit which generates the first to third demultiplex control signals according to the multiplex timing of the data signals for the first to third color components based on the input shift clock signal.

According to a third aspect of the present invention, there is provided an electro-optical device comprising:

a plurality of pixels;

a plurality of scanning lines;

a plurality of signal lines through each of which a multiplexed data signal for first to third color components is transmitted;

a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels; and a gate signal generation circuit which generates a gate signal output to one of the scanning lines by using the first to third demultiplex control signals, wherein the gate signal generation circuit also generates a shift clock signal based on the first to third demultiplex control signals, shifts a start pulse signal based on the shift clock signal to obtain a shift output, and outputs a signal corresponding to the shift output to one of the scanning lines.

According to a fourth aspect of the present invention, there is provided an electro-optical device comprising:

a plurality of pixels;

a plurality of scanning lines;

a plurality of signal lines through each of which a multiplexed data signal for first to third color components is transmitted;

a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels; and a gate signal generation circuit which generates a shift clock signal based on an input shift clock signal, shifts a start pulse signal based on the shift clock signal to obtain a shift output, and outputs a signal corresponding to the shift output to one of the scanning lines, wherein the gate signal generation circuit includes:

a shift clock generation circuit which generates the shift clock signal by dividing a frequency of the input shift clock signal into three; and a demultiplex control signal generation circuit which generates the first to third demultiplex control signals according to the multiplex timing of the data signals for the first to third color components based on the input shift clock signal.

According to a fifth aspect of the present invention, there is provided a method of driving an electro-optical device which has:

a plurality of pixels;

a plurality of scanning lines;

a plurality of signal lines through each of which a multiplexed data signal for first to third color components is transmitted; and a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels, the method comprising:

generating a shift clock signal based on the first to third demultiplex control signals; and outputting a signal corresponding to a shift output to one of the scanning lines, the shift output being obtained by shifting a start pulse signal based on the shift clock signal.

According to a sixth aspect of the present invention, there is provided a method of driving an electro-optical device which has:

a plurality of pixels;

a plurality of scanning lines;

a plurality of signal lines through each of which a multiplexed data signal for first to third color components is transmitted; and a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels, the method comprising:

generating the first to third demultiplex control signals according to the multiplex timing of the data signals for the first to third color components based on an input shift clock signal, and generating a shift clock signal by dividing a frequency of the input shift clock signal into three; and outputting a signal corresponding to a shift output to one of the scanning lines, the shift output being obtained by shifting a start pulse signal based on the shift clock signal.

DETAILED DESCRIPTION OF THE EMBODIMENTS

Figure 1:
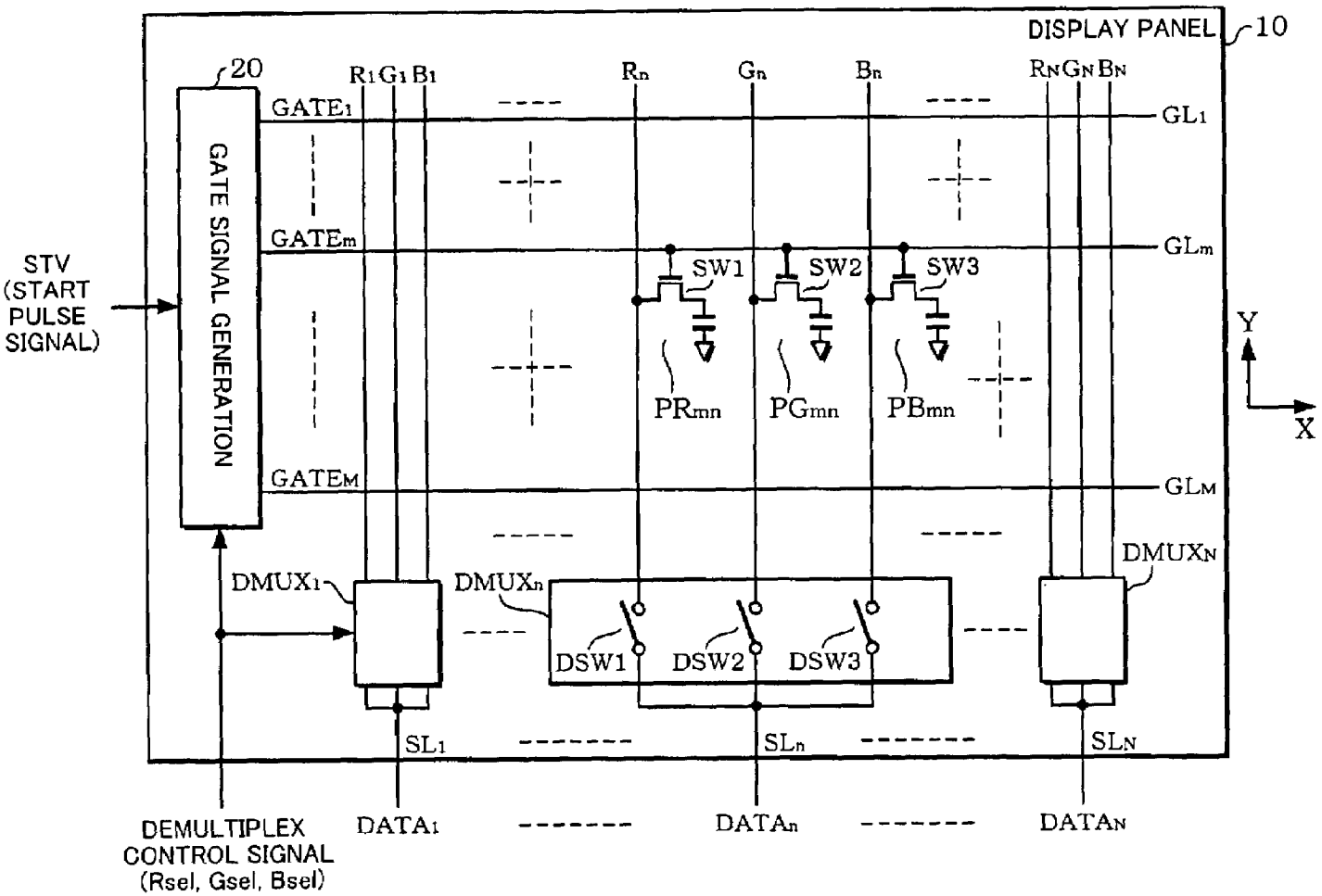
FIG. 1 is a diagram schematically showing the configuration of a display panel according to the first embodiment of the present invention.

Embodiments of the present invention are described below. Note that the embodiments described below do not in any way limit the scope of the invention laid out in the claims herein. In addition, all of the elements of the embodiments described below should not be taken as essential requirements of the present invention.

According to the LTPS process, a driver circuit and the like can be directly formed on a panel substrate (glass substrate, for example) on which pixels including a switching element (thin film transistor (TFT), for example) and the like are formed. This enables the number of parts to be decreased, whereby the size and weight of the display panel can be reduced. Moreover, LTPS enables the pixel size to be reduced by applying a conventional silicon process technology while maintaining the aperture ratio. Furthermore, LTPS has high charge mobility and small parasitic capacitance in comparison with amorphous silicon (a-Si). Therefore, a charging period of the pixel formed on the substrate can be secured even if the pixel select period per pixel is reduced due to an increase in the screen size, whereby the image quality can be improved.

In a display panel in which the TFT is formed by using LTPS, the entire drivers (driver circuits) which drive the display panel can be formed on the panel. However, this results in a problem relating to reduction of the size or an increase in the speed in comparison with the case where an IC is mounted on a silicon substrate. Therefore, a method of forming a part of the functions of the drivers on the display panel has been studied.

A display panel may be provided with a demultiplexer which connects one signal line with one of R, G, and B signal lines which can be connected with pixel electrodes for R, G, and B (first to third color components). In this case, display data for R, G, and B is transmitted on the signal line by time division by utilizing the high charge mobility of LTPS. The display data for each color component is consecutively output to the R, G, and B signal lines by the demultiplexer in the select period of the R, G, and B pixels, and written in the pixel electrodes provided for each color component. According to this configuration, the number of terminals for outputting the display data to the signal line from the driver can be reduced. Therefore, it is possible to deal with an increase in the number of signal lines due to reduction of the pixel size without being restricted by the pitch between the terminals.

However, it is desirable to reduce the number of terminals of the display panel in the case of further reducing the power consumption of the entire device including the driver and the display panel. In this case, the number of signals transmitted between the display panel and the driver must be reduced without causing the image quality of the display panel to deteriorate.

According to the following embodiments, a driver circuit for an electro-optical device capable of reducing the number of terminals without causing the image quality to deteriorate in the case where the electro-optical device and the driver circuit are formed on a single substrate, an electro-optical device, and a method of driving the same can be provided.

The embodiments of the present invention are described below in detail with reference to the drawings.

The following description is given taking a display panel (liquid crystal panel) in which a TFT is formed as a switching element by using LTPS as an example of an electro-optical device. However, the present invention is not limited thereto.

1. First Embodiment

FIG. 1 schematically shows the configuration of a display panel according to a first embodiment. A display panel (electro-optical device in a broad sense) 10 in the first embodiment includes a plurality of scanning lines (gate lines), a plurality of signal lines (data lines), and a plurality of pixels. The scanning lines and the signal lines are disposed to intersect. The pixels are specified by the scanning lines and the signal lines.

In the display panel 10, the pixels are selected by each of the scanning lines (GL) and each of the signal lines (SL) in units of three pixels. A color component signal which is transmitted through one of three color component signal lines (R, G, B) corresponding to the signal line is written in each selected pixel. Each of the pixels includes a TFT and a pixel electrode.

In the display panel 10, the scanning lines and the signal lines are formed on a panel substrate such as a glass substrate. In more detail, a plurality of scanning lines $GL_1$ to $GL_M$ (M is an integer of two or more) which are arranged in the Y direction and extend in the X direction, and a plurality of signal lines $SL_1$ to $SL_N$ (N is an integer of two or more) which are arranged in the X direction and extend in the Y direction are disposed on the panel substrate shown in FIG. 1. First to third color component signal lines ($R_1$, $G_1$, $B_1$) to ($R_N$, $G_N$, $B_N$) (first to third color component signal lines make a set) which are arranged in the X direction and extend in the Y direction are formed on the panel substrate.

R pixels (first color component pixels) PR ($PR_{11}$ to $PR_{MN}$) are formed at intersecting points of the scanning lines $GL_1$ to $GL_M$ and the first color component signal lines $R_1$ to $R_N$. G pixels (second color component pixels) PG ($PG_{11}$ to $PG_{MN}$) are formed at intersecting points of the scanning lines $GL_1$ to $GL_M$ and the second color component signal lines $G_1$ to $G_N$. B pixels (third color component pixels) PB ($PB_{11}$ to $PB_{MN}$) are formed at intersecting points of the scanning lines $GL_1$ to $GL_M$ and the third color component signal lines $B_1$ to $B_N$.

Figure 2A:
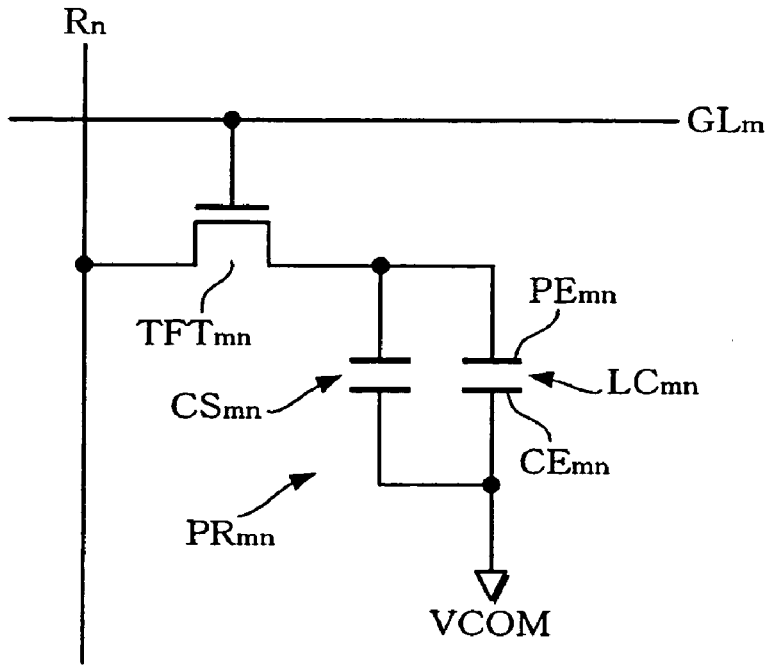
FIGS. 2A and 2B are diagrams each showing the configuration of a color component pixel.
Figure 2B:
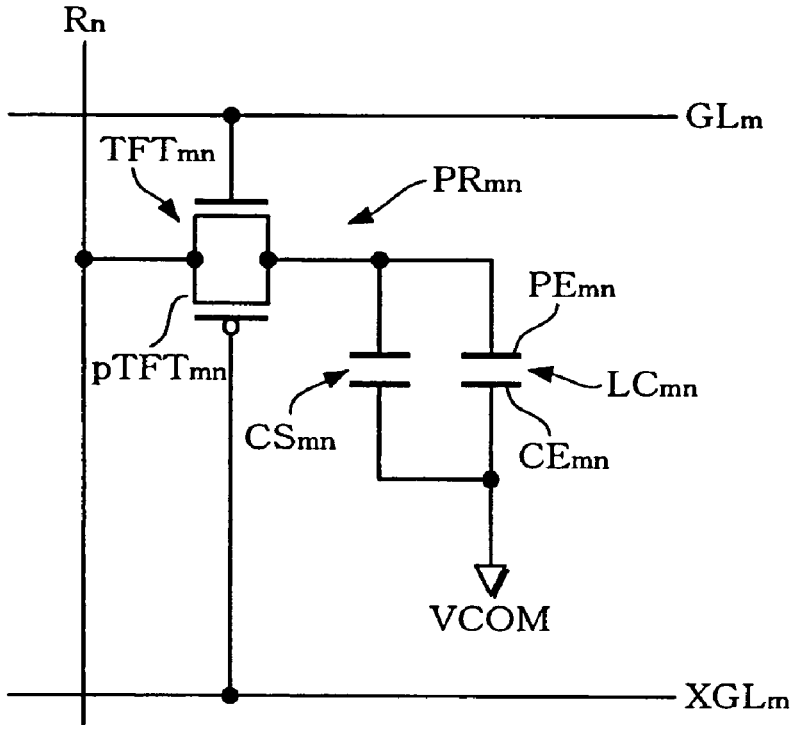

FIGS. 2A and 2B show the configuration of the color component pixel. FIGS. 2A and 2B show configuration examples of the R pixel $PR_{mn}$ ($1 \leqq m \leqq M$, $1 \leqq n \leqq N$, m and n are integers). Other color component pixels have the same configuration as the R pixel.

In FIG. 2A, the $TFT_{mn}$ as a first switching element SW1 is an n-type transistor. A gate electrode of the $TFT_{mn}$ is connected with the scanning line $GL_m$. A source electrode of the $TFT_{mn}$ is connected with the first color component signal line $R_n$. A drain electrode of the $TFT_{mn}$ is connected with the pixel electrode $PE_{mn}$. A common electrode $CE_{mn}$ is formed to face the pixel electrode $PE_{mn}$. A common voltage VCOM is applied to the common electrode $CE_{mn}$. A liquid crystal material is interposed between the pixel electrode $PE_{mn}$ and the common electrode $CE_{mn}$, whereby a liquid crystal layer $LC_{mn}$ is formed. The transmittance of the liquid crystal layer $LC_{mn}$ changes corresponding to the voltage applied between the pixel electrode $PE_{mn}$ and the common electrode $CE_{mn}$. A storage capacitor $CS_{mn}$ is formed in parallel with the pixel electrode $PE_{mn}$ and the common electrode $CE_{mn}$ in order to compensate for charge leakage of the pixel electrode $PE_{mn}$. One end of the storage capacitor $CS_{mn}$ is set at the same potential as the pixel electrode $PE_{mn}$. The other end of the storage capacitor $CS_{mn}$ is set at the same potential as the common electrode $CE_{mn}$.

As shown in FIG. 2B, a transfer gate may be used as the first switching element SW1. The transfer gate is made up of an n-type transistor $TFT_{mn}$ and a p-type transistor $pTFT_{mn}$. A gate electrode of the $pTFT_{mn}$ must be connected with a scanning line $XGL_m$ of which the logic level is the inverse of that of the scanning line $GL_m$. In FIG. 2B, a configuration is employed in which an offset voltage corresponding to the voltage to be written is unnecessary.

In FIG. 1, a gate signal generation circuit 20 and demultiplexers $DMUX_1$ to $DMUX_N$ provided corresponding to each signal line are formed on the panel substrate.

The scanning lines $GL_1$ to $GL_M$ are connected with the gate signal generation circuit 20. A demultiplex control signal and a start pulse signal STV are input to the gate signal generation circuit 20. The demultiplex control signal is a signal for controlling switching of each of the demultiplexers. The start pulse signal STV is a pulse signal which indicates start timing of one frame of a scanning period.

The gate signal generation circuit 20 generates gate signals (select signals) $GATE_1$ to $GATE_M$ based on the start pulse signal STV. The gate signals $GATE_1$ to $GATE_M$ are respectively output to the scanning lines $GL_1$ to $GL_M$. The gate signals $GATE_1$ to $GATE_M$ are pulse signals which exclusively go active in one frame of a scanning period started by the start pulse signal STV.

In FIG. 1, the first to third switching elements SW1 to SW3 are switch-controlled (ON/OFF controlled) by the gate signal $GATE_m$ supplied to the scanning line $GL_m$. The color component signal line is electrically connected with the pixel electrode when the switching element is in an ON state.

The gate signals $GATE_1$ to $GATE_M$ are signals corresponding to shift output obtained by allowing a shift register to shift the start pulse signal STV, for example.

The shift register includes a plurality of flip-flops, and performs a shift operation based on a shift clock signal input in common to each flip-flop. The shift clock signal is a timing signal which specifies timing for consecutively selecting each scanning line. The shift clock signal is generated by the gate signal generation circuit 20 based on the demultiplex control signal.

The demultiplex control signal is supplied from a source driver (signal line driver circuit) provided outside the display panel 10, for example. The signal lines $SL_1$ to $SL_N$ are driven by the source driver (signal line driver circuit) provided outside the display panel 10, for example. The source driver outputs a data signal corresponding to gray-scale data to each color component pixel. The source driver outputs voltages (data signals) which are time-divided for each color component pixel and correspond to the gray-scale data for each color component to each color component signal line. The source driver generates the demultiplex control signal for selectively outputting the voltages corresponding to the gray-scale data for each color component to each color component signal line in synchronization with the time-division timing, and outputs the demultiplex control signal to the display panel 10.

Figure 3:
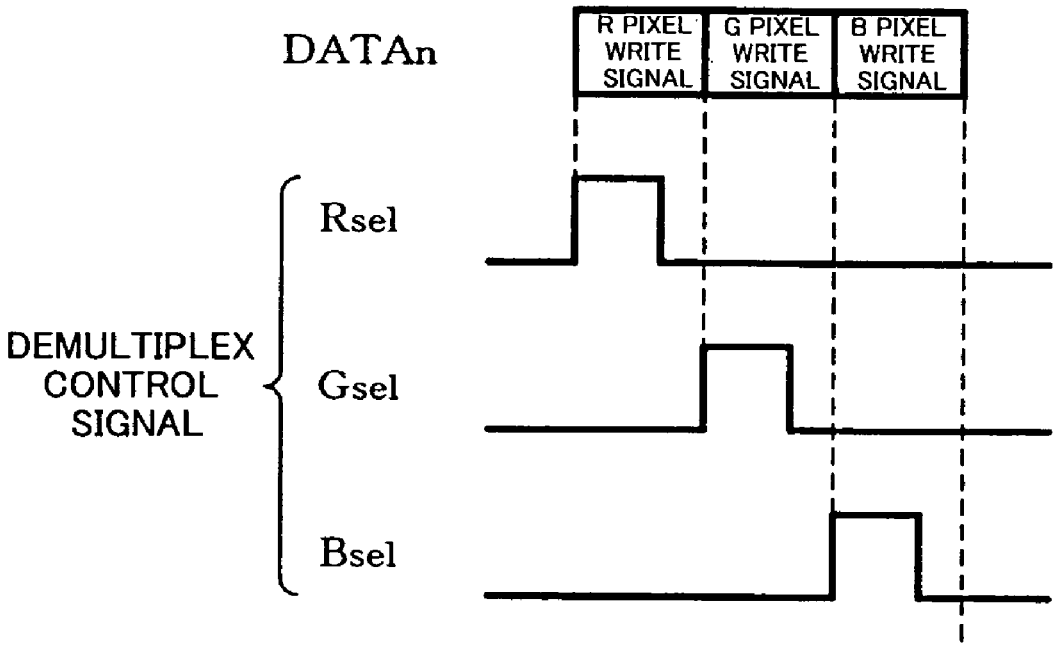
FIG. 3 is a diagram showing the relationship between a data signal output to a signal line and a demultiplex control signal.

FIG. 3 schematically shows the relationship between the data signal output to the signal line by the source driver and the demultiplex control signal. The data signal $DATA_n$ output to the signal line $SL_n$ is shown in this figure.

The source driver outputs the data signal in which the voltages corresponding to the gray-scale data (display data) for each color component are time-division multiplexed to each signal line. In FIG. 3, the source driver multiplexes a write signal to the R pixel, a write signal to the G pixel, and a write signal to the B pixel and outputs the multiplexed signal to the signal line $SL_n$. The write signal to the R pixel is a write signal to the R pixel $PR_{mn}$ selected by the scanning line $GL_{mn}$ from the R pixels $PR_{1n}$ to $PR_{Mn}$ corresponding to the signal line $SL_n$, for example. The write signal to the G pixel is a write signal to the G pixel $PG_{mn}$ selected by the scanning line $GL_m$ from the G pixels $PG_{1n}$ to $PG_{Mn}$ corresponding to the signal line $SL_n$, for example. The write signal to the B pixel is a write signal to the B pixel $PB_{mn}$ selected by the scanning line $GL_m$ from the B pixels $PB_{1n}$ to $PB_{Mn}$ corresponding to the signal line $SL_n$, for example.

The source driver generates the demultiplex control signal in synchronization with the time-division timing of the write signals for each color component which are multiplexed into the data signal $DATA_n$. The demultiplex control signal includes first to third demultiplex control signals (Rsel, Gsel, Bsel).

The demultiplexer $DMUX_n$ corresponding to the signal line $SL_n$ is formed on the panel substrate. The demultiplexer $DMUX_n$ includes first to third (i=3) demultiplexing switch elements DSW1 to DSW3.

The first to third color component signal lines ($R_n$, $G_n$, $B_n$) are connected with the output side of the demultiplexer $DMUX_n$. The signal line $SL_n$ is connected with the input side of the demultiplexer $DMUX_n$. The demultiplexer $DMUX_n$ electrically connects the signal line $SL_n$ with one of the first to third color component signal lines ($R_n$, $G_n$, $B_n$) corresponding to the demultiplex control signal. The demultiplex control signal is input in common to the demultiplexers $DMUX_1$ to $DMUX_N$.

The first demultiplexing switch element DSW1 is ON/OFF controlled by the first demultiplex control signal Rsel. The second demultiplexing switch element DSW2 is ON/OFF controlled by the second demultiplex control signal Gsel. The third demultiplexing switch element DSW3 is ON/OFF controlled by the third demultiplex control signal Bsel. The first to third demultiplex control signals (Rsel, Gsel, Bsel) cyclically (periodically) and consecutively go active. Therefore, the demultiplexer $DMUX_n$ cyclically and consecutively connects the signal line $SL_n$ electrically with the first to third color component signal lines ($R_n$, $G_n$, $B_n$).

In the display panel 10 having such a configuration, the time-divided voltages corresponding to the gray-scale data for the first to third color components are output to the signal line $SL_n$. In the demultiplexer $DMUX_n$, the voltages corresponding to the gray-scale data for each color component are applied to the first to third color component signal lines ($R_n$, $G_n$, $B_n$) by the first to third demultiplex control signals (Rsel, Gsel, Bsel) generated in synchronization with the time-division timing. The color component signal line is electrically connected with the pixel electrode in one of the first to third color component pixels ($PR_{mn}$, $PG_{mn}$, $PB_{mn}$) selected by the scanning line $GL_m$.

In FIG. 1, a circuit having a part or all of the function of the circuit which generates the start pulse signal STV or a part or all of the function of the source driver may be formed on the panel substrate of the display panel 10.

The function of the driver circuit of the display panel 10 is realized by a part or all of the circuit formed by the gate signal generation circuit 20, the demultiplexers $DMUX_1$ to $DMUX_N$, and the source driver having the above-described function.

The gate signal generation circuit 20 generates the gate signal as described below.

Figure 4:
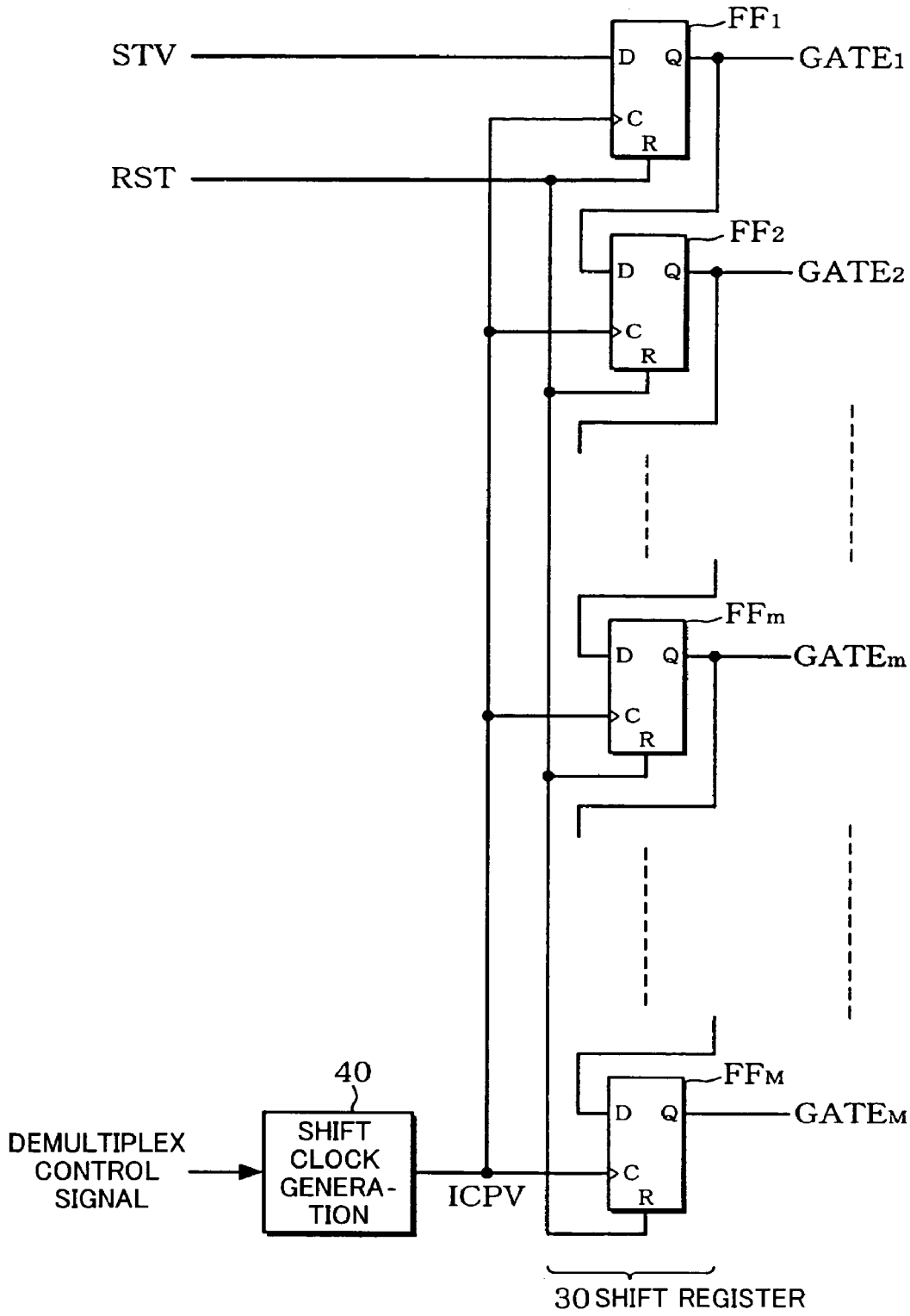
FIG. 4 is a circuit diagram showing the configuration of a gate signal generation circuit.

FIG. 4 shows the configuration of the gate signal generation circuit 20. The gate signal generation circuit 20 includes a shift register 30 and a shift clock generation circuit 40.

The shift register 30 includes a plurality of flip-flops $FF_1$ to $FF_M$. The output of the flip-flop $FF_p$ ($1 \leqq p \leqq M-1$, p is an integer) is connected with the input of the flip-flop $FF_{p+1}$ in the subsequent stage. The output of the flip-flop $FF_p$ is connected with the scanning line $GL_p$.

The flip-flop $FF_p$ includes an input terminal D, a clock input terminal C, an output terminal Q, and a reset terminal R. The flip-flop $FF_P$ latches a signal input to the input terminal D at a rising edge of a signal input to the clock input terminal C. The flip-flop $FF_p$ outputs the latched signal from the output terminal Q. The flip-flop $FF_p$ initializes the latched content when the logic level of a signal input to the reset terminal R becomes "H", and sets the logic level of the signal output from the output terminal Q to "L".

The start pulse signal STV is input to the input terminal D of the flip-flop $FF_1$. A given reset signal RST is input in common to the reset terminals R of the flip-flops $FF_1$ to $FF_M$. A shift clock signal ICPV generated by the shift clock generation circuit 40 is input to the clock input terminals C of the flip-flops $FF_1$ to $FF_M$.

In the shift register 30 having such a configuration, the output of each flip-flop is reset by the reset signal RST. The start pulse signal STV input to the flip-flop $FF_1$ is shifted in synchronization with the shift clock signal ICPV. The shift output from each flip-flop or a signal corresponding to the shift output is output to the scanning lines $GL_1$ to $GL_M$. This enables the gate signals $GATE_1$ to $GATE_M$ which exclusively select each scanning line to be output to the scanning lines $GL_1$ to $GL_M$.

The shift clock generation circuit 40 generates the shift clock signal ICPV based on the demultiplex control signal.

Figure 5:
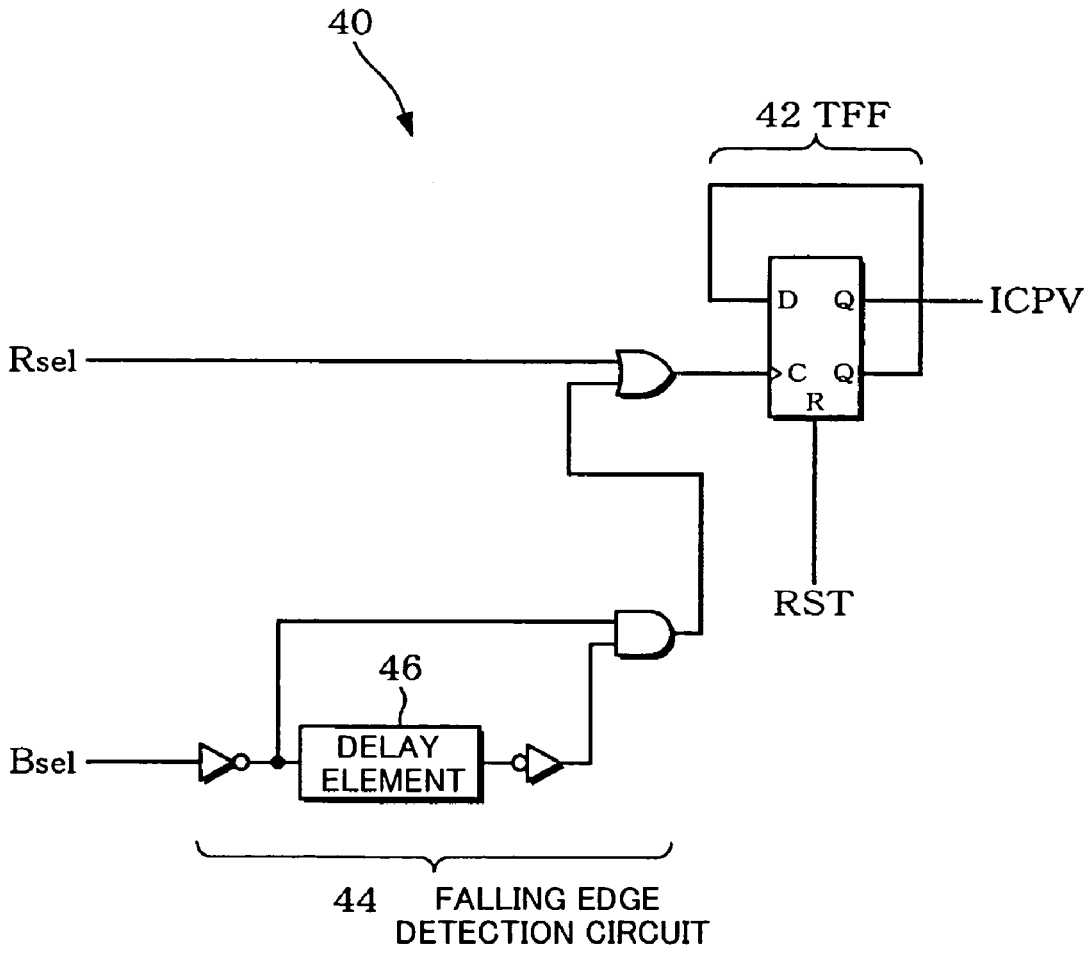
FIG. 5 is a circuit diagram showing the configuration of a shift clock generation circuit.

The configuration of the shift clock generation circuit 40 is shown in FIG. 5. This figure shows the configuration of a circuit which generates the shift clock signal by using the first and third demultiplex control signals (Rsel and Bsel) among the first to third demultiplex control signals (Rsel, Gsel, Bsel) which make up the demultiplex control signal.

The shift clock generation circuit 40 includes a T flip-flop (TFF) 42 and a falling edge detection circuit 44. The TFF 42 inverts the logic level of the shift clock signal ICPV output from an output terminal Q at a rising edge of a signal input to the clock input terminal C. The TFF 42 sets the logic level of the signal output from the output terminal Q to "L" by a signal input to a reset input terminal R.

The falling edge detection circuit 44 detects the falling edge of the third demultiplex control signal Bsel. In more detail, the falling edge detection circuit 44 outputs a pulse signal of which the rising edge corresponds to a falling edge of the third demultiplex control signal Bsel. The pulse width of the pulse signal is determined depending on the delay time of a delay element 46.

The logical OR result of the first demultiplex control signal Rsel and the output of the falling edge detection circuit 44 is input to the input terminal C of the TFF 42.

The shift clock generation circuit 40 having such a configuration generates the shift clock signal ICPV of which the logic level is changed at a rising edge of the first demultiplex control signal Rsel. The shift clock generation circuit 40 generates the shift clock signal ICPV of which the logic level is changed at a falling edge of the third demultiplex control signal Bsel.

Figure 6:
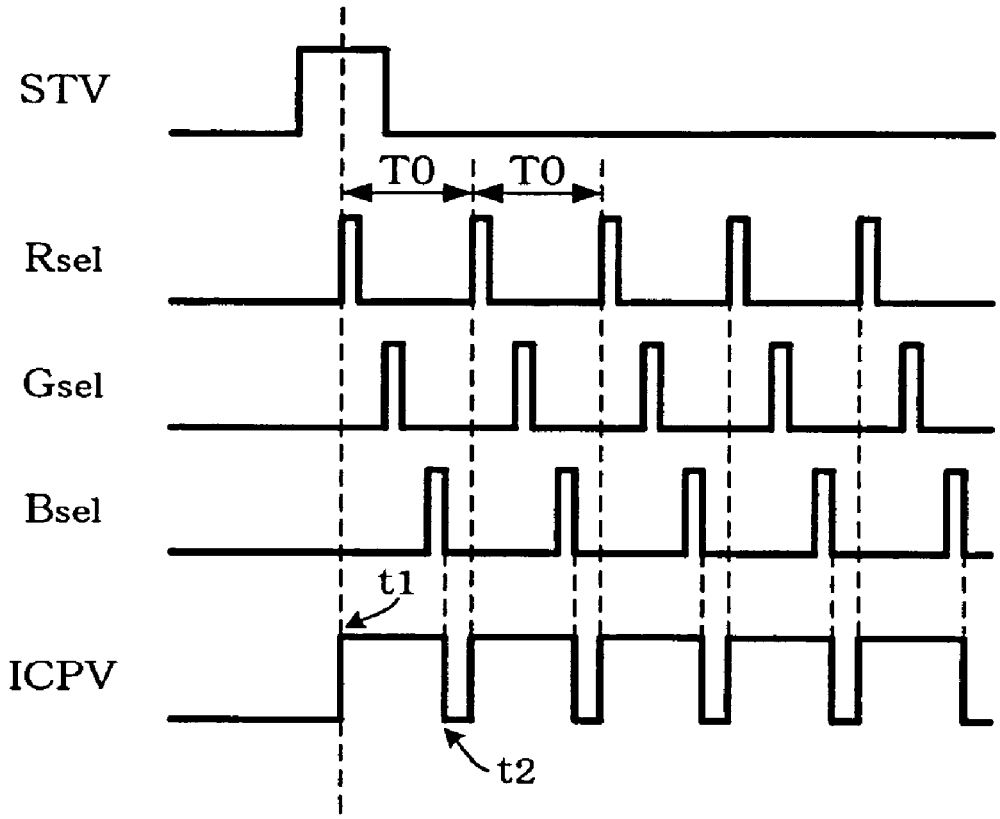
FIG. 6 is a timing chart showing an operation of a shift clock generation circuit.

FIG. 6 shows a timing chart of an operation of the shift clock generation circuit 40. The TFF 42 is in a state in which the shift clock signal ICPV output from the output terminal Q is reset by the reset signal RST. The logic level of the output signal of the TFF 42 is inverted at a rising edge of the first demultiplex control signal Rsel, whereby the logic level of the shift clock signal ICPV becomes "H" (t1). The logic level of the output signal of the TFF 42 is inverted at a falling edge of the third demultiplex control signal Bsel, whereby the logic level of the shift clock signal ICPV becomes "L" (t2).

In the TFF 42, the logic level of the output signal is repeatedly inverted at a rising edge of the first demultiplex control signal Rsel or a falling edge of the third demultiplex control signal Bsel.

As a result, the shift clock signal ICPV having a cycle of a period T0 in which the first to third demultiplex control signals (Rsel, Gsel, Bsel) consecutively go active is generated.

Figure 7:
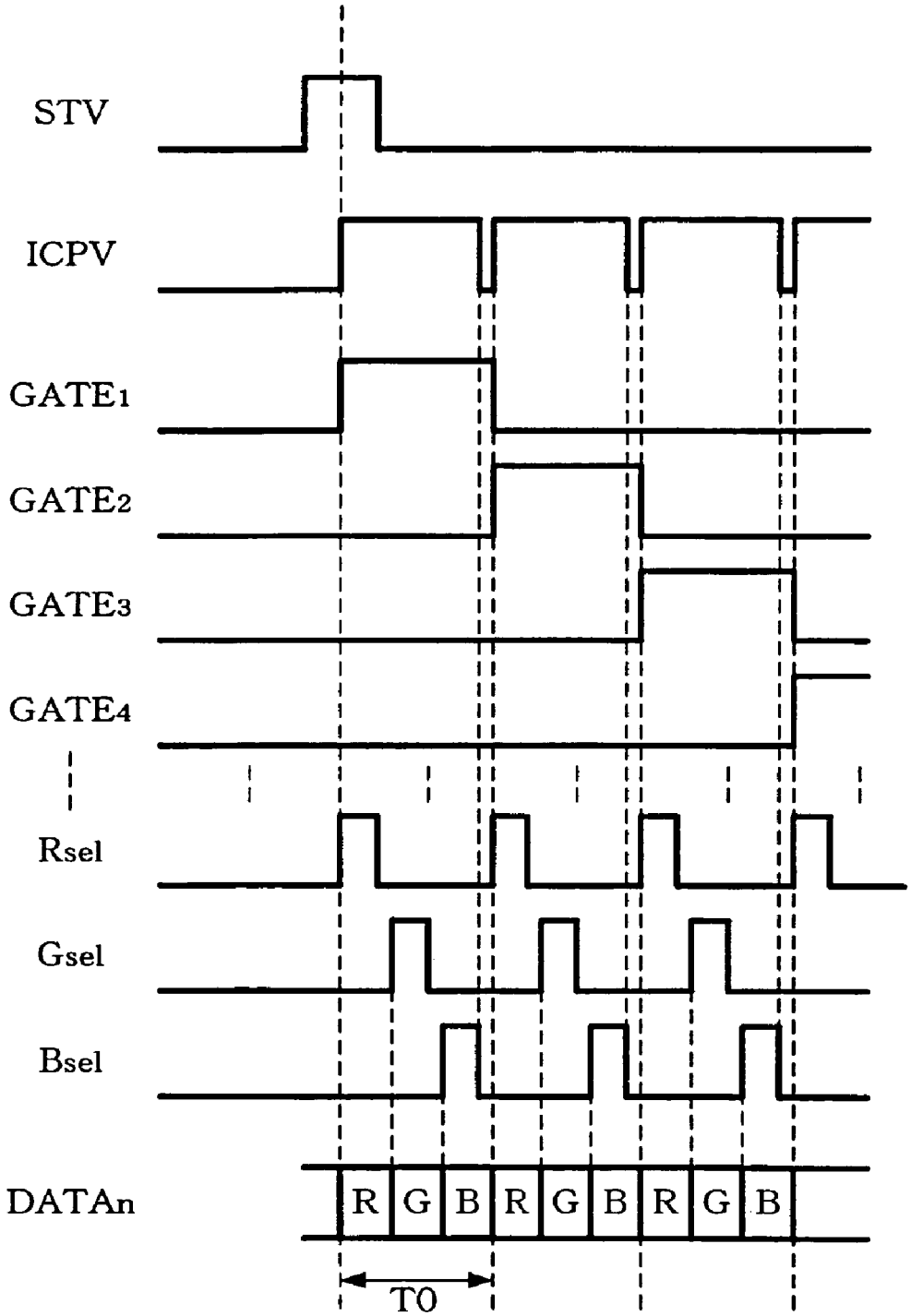
FIG. 7 is a timing chart showing operational timing of a display panel.

FIG. 7 shows a timing chart showing operational timing of the display panel 10. A signal in which each color component signal is time-division multiplexed is output to each signal line of the display panel 10 by the source driver (not shown). The source driver outputs the first to third demultiplex control signals (Rsel, Gsel, Bsel) which are in synchronization with the time-division timing of each color component signal to the display panel 10. The start pulse signal STV is input to the display panel 10 by the source driver or an external circuit other than the source driver.

The circuit which supplies the start pulse signal STV to the display panel 10 is operated in synchronization with the output timing of each color component signal to each signal line by the source driver. Therefore, the first demultiplex control signal Rsel is supplied to the display panel 10 so as to have a period in which the first demultiplex control signal Rsel overlaps the start pulse signal STV, as shown in FIG. 7.

In the shift clock generation circuit 40, the logic level of the shift clock signal ICPV is changed to "H" at a rising edge of the first demultiplex control signal Rsel after the output signal of the TFF 42 is reset, as shown in FIG. 6. The shift output of the start pulse signal STV in the first stage is output as the gate signal $GATE_1$ by the gate signal generation circuit 20 shown in FIG. 4.

Therefore, the period TO shown in FIG. 7 corresponds to one horizontal scanning period (1H), in which each color component signal is written in each pixel selected by the scanning line $GL_1$ through the signal lines $SL_1$ to $SL_N$. In more detail, the voltages corresponding to the gray-scale data for each color component selectively output to the first to third color component signal lines by the first to third demultiplex control signals (Rsel, Gsel, Bsel) are written in the R pixels $PR_{11}$ to $PR_{1N}$, the G pixels $PG_{11}$ to $PG_{1N}$, and the B pixels $PB_{11}$ to $PB_{1N}$ selected by the gate signal $GATE_1$ within the 1H period.

The shift clock signal ICPV which is set at a logic level "H" at a rising edge of the first demultiplex control signal Rsel is changed to a logic level "L" at a falling edge of the third demultiplex control signal Bsel within the 1H period. The logic level of the shift clock signal ICPV is changed to "H" at a rising edge of the first demultiplex control signal Rsel in the next 1H period.

The gate signal corresponding to the shift output is consecutively output to the scanning lines $GL_2$ to $GL_M$ in the same manner as described above each time the period T0 has elapsed.

The effect of the above embodiment is described below by comparing with a comparison example of the display panel.

Figure 8:
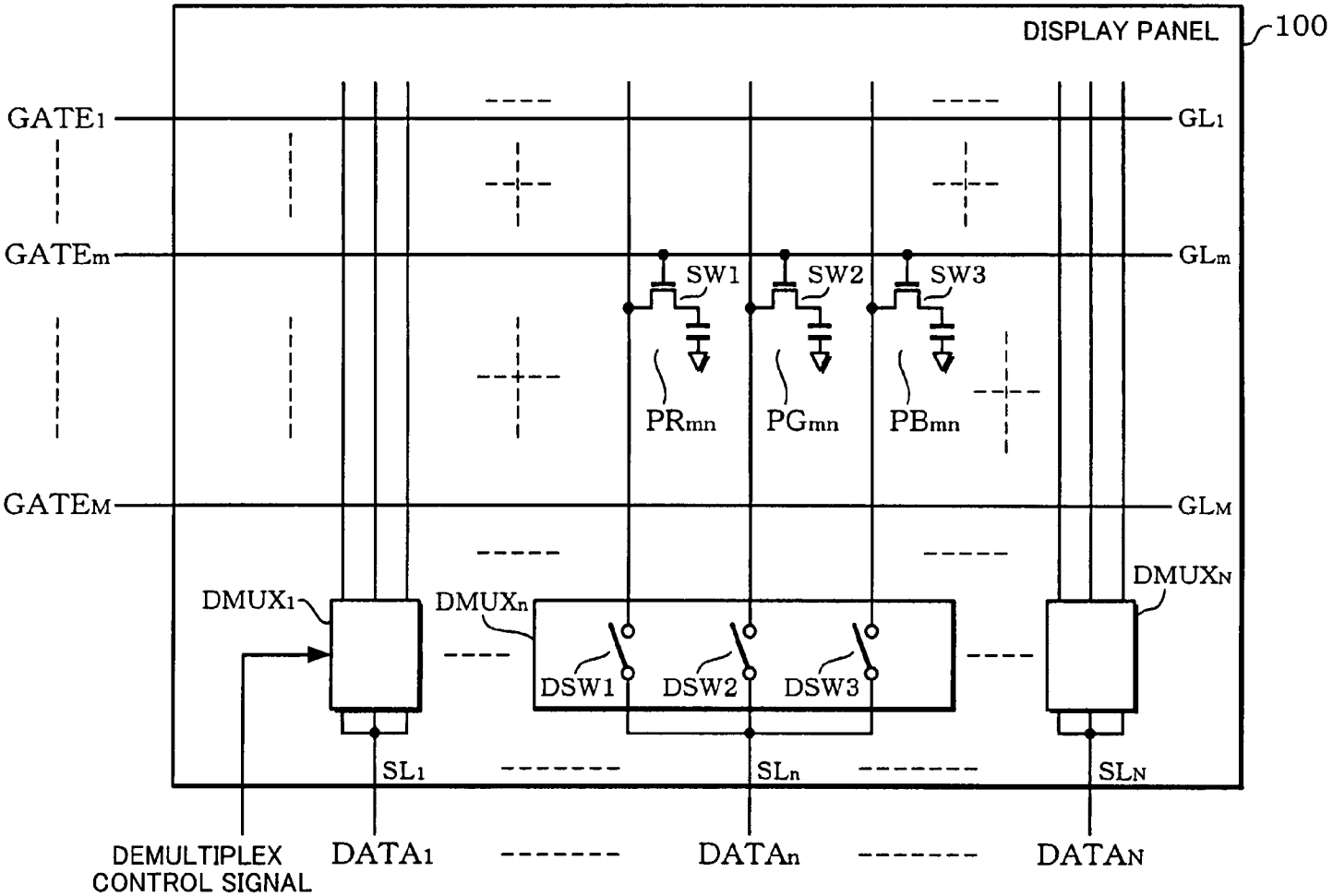
FIG. 8 is a diagram schematically showing the configuration of a comparative example of a display panel.

FIG. 8 schematically shows the configuration of a comparative example of the display panel. Note that components corresponding to those of the display panel 10 shown in FIG. 1 are denoted by the same reference numbers and further description thereof is omitted.

A display panel 100 in the comparative example differs from the display panel 10 shown in FIG. 1 in that the display panel 100 does not include the gate signal generation circuit 20. Therefore, in the display panel 100 in the comparative example, the gate signals $GATE_1$ to $GATE_M$ are respectively supplied to the scanning lines $GL_1$ to $GL_M$ by an external gate driver (not shown).

The operation timing of the display panel 100 in the comparative example is the same as the operation timing of the display panel 10 with respect to the start pulse signal STV, the gate signals $GATE_1$ to $GATE_M$, the first to third demultiplex control signals (Rsel, Gsel, Bsel), and the data signal $DATA_n$ (see FIG. 7).

However, if the number of terminals of the display panel 10 is compared with the number of terminals of the display panel 100, the number of terminals "M+3" is necessary for inputting the gate signals and the demultiplex control signals in the display panel 100.

Therefore, the number of terminals may be reduced by forming a circuit which generates the gate signals on the panel substrate which makes up the display panel 100. In this case, since the gate signal must be generated in synchronization with the output timing of the data signal, at least the start pulse signal STV and the shift clock signal are supplied from the outside of the display panel 100. Therefore, the number of terminals is reduced to "5" in the display panel 100 for inputting the start pulse signal STV, the shift clock signal, and the demultiplex control signals. It is difficult to form a complicated circuit, such as the source driver, on the panel substrate on which the circuit can be formed by using the LTPS process, taking the yield, circuit scale, speed, or cost into consideration.

In the display panel 10, the gate signal generation circuit 20 is formed on the panel substrate. Therefore, since the shift clock signal is generated by the gate signal generation circuit 20 in the display panel 10, the number of terminals can be reduced to "4" for inputting the start pulse signal STV and the demultiplex control signals. Therefore, power consumption can be further reduced.

1.1 First Modification

The shift clock generation circuit 40 of the gate signal generation circuit 20 formed on the display panel on which the TFT is formed by using LTPS is not limited to the shift clock generation circuit shown in FIG. 5.

Figure 9:
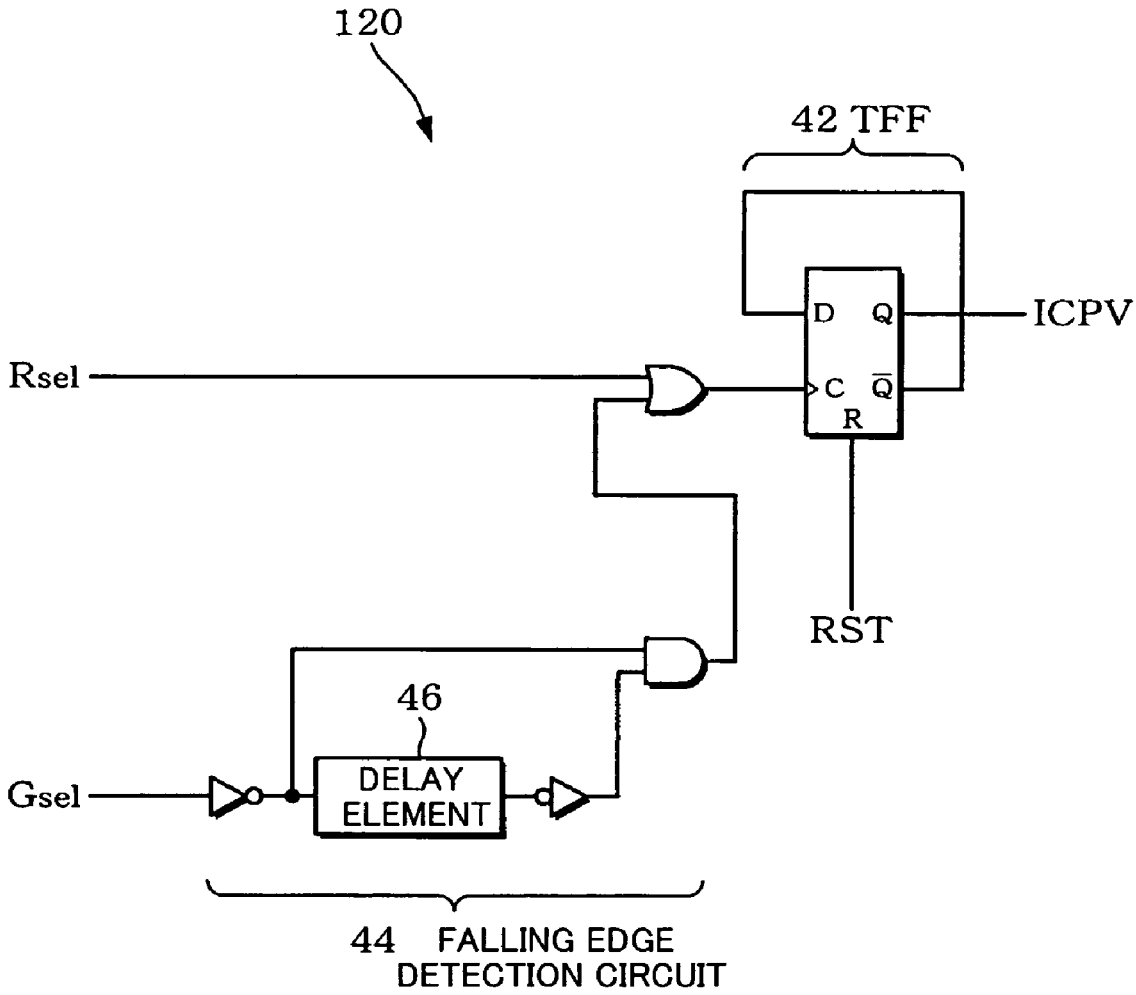
FIG. 9 is a circuit diagram showing the configuration of a first modification of the shift clock generation circuit.

FIG. 9 shows the configuration of a first modification of the shift clock generation circuit. Note that components corresponding to those of the shift clock generation circuit 40 shown in FIG. 5 are denoted by the same reference numbers and further description thereof is omitted.

A shift clock generation circuit 120 in the first modification may be applied to the gate signal generation circuit 20 shown in FIG. 4 instead of the shift clock generation circuit 40. The shift clock generation circuit 120 differs from the shift clock generation circuit 40 in that the falling edge detection circuit 44 detects a falling edge of the second demultiplex control signal Gsel.

Figure 10:
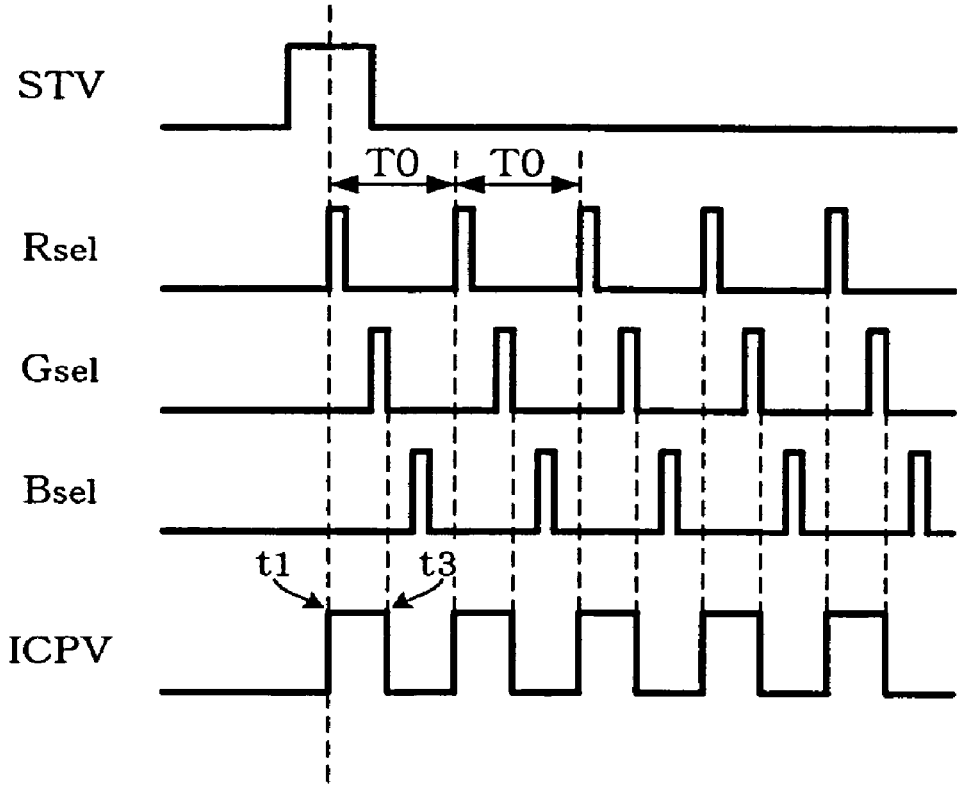
FIG. 10 is a timing chart showing an operation of the first modification of the shift clock generation circuit.

FIG. 10 shows a timing chart showing an operation of the first modification of the shift clock generation circuit 120. In the shift clock generation circuit 120, since a falling edge of the second demultiplex control signal Gsel is detected, the shift clock signal ICPV which is changed to a logic level "L" at a falling edge of the second demultiplex control signal Gsel is output from the output terminal Q of the TFF 42 (t3). Other details are the same as the details of the timing chart shown in FIG. 6.

In the first modification, since the shift clock signal can be generated in the display panel, the number of terminals can be reduced in the same manner as in the above-described embodiment.

1.2 Second Modification

The shift clock generation circuit of the gate signal generation circuit 20 generates the shift clock signal ICPV by using the TFF as shown in FIGS. 5 and 9. However, the present invention is not limited thereto.

Figure 11:
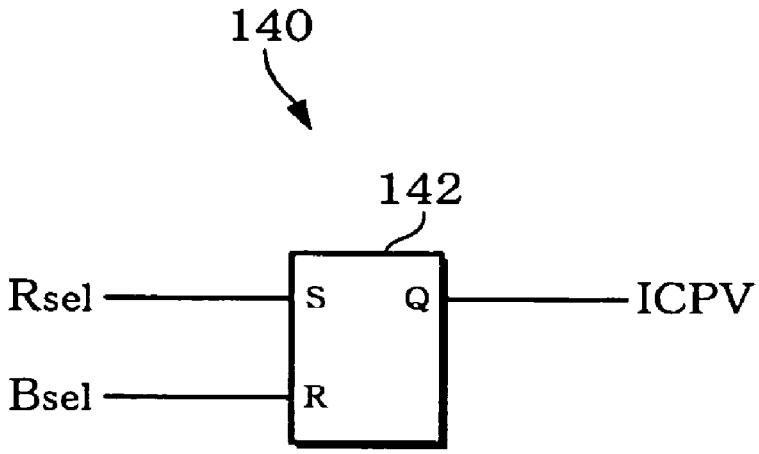
FIG. 11 is a circuit diagram showing the configuration of a second modification of the shift clock generation circuit.

FIG. 11 shows the configuration of a second modification of the shift clock generation circuit. A shift clock generation circuit 140 in the second modification may be applied to the gate signal generation circuit 20 shown in FIG. 4 instead of the shift clock generation circuit 40.

The shift clock generation circuit 140 includes a reset set (RS) flip-flop (RSFF) 142. The RSFF 142 includes a set terminal S, a reset terminal R, and an output terminal Q. In the RSFF 142, if the logic level of a signal input to the set terminal S becomes "H", a signal output from the output terminal Q is set to a logic level "H" In the RSFF 142, if the logic level of a signal input to the reset terminal R becomes "H", the signal output from the output terminal Q is reset to a logic level "L".

The first demultiplex control signal Rsel is input to the set terminal S of the RSFF 142. The third demultiplex control signal Bsel is input to the reset terminal R of the RSFF 142. The shift clock signal ICPV is output from the output terminal Q of the RSFF 142.

The shift clock generation circuit 140 having such a configuration generates the shift clock signal ICPV which is set by the first demultiplex control signal Rsel and is reset by the third demultiplex control signal Bse.

Figure 12:
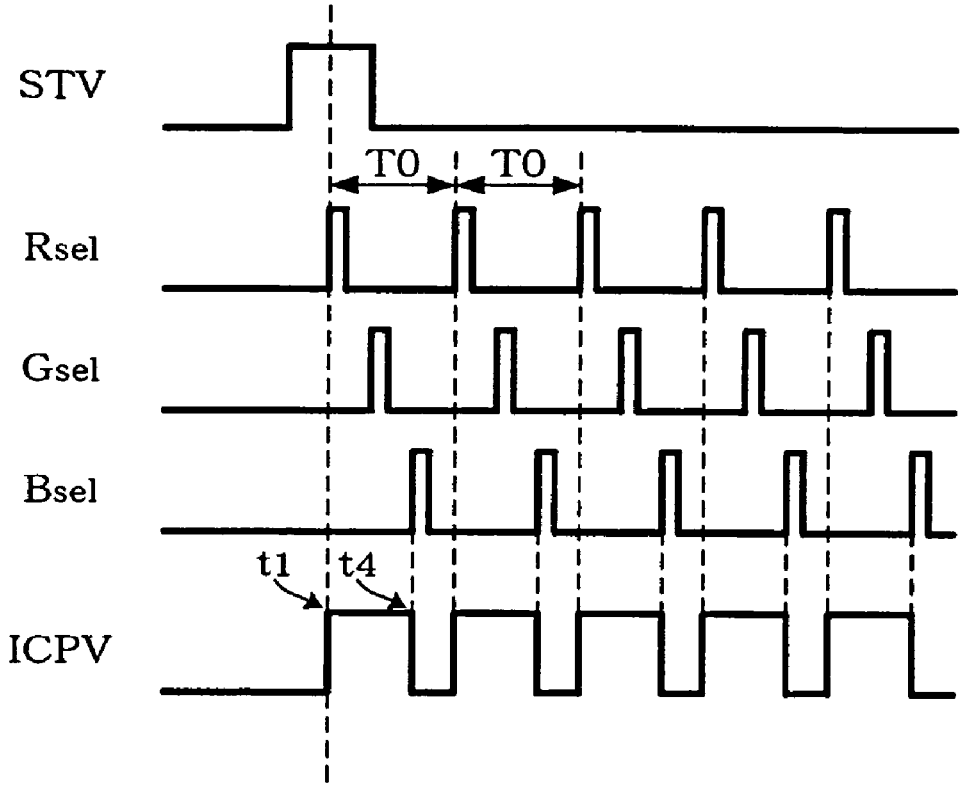
FIG. 12 is a timing chart showing an operation of the second modification of the shift clock generation circuit.

FIG. 12 shows a timing chart showing an operation of the second modification of the shift clock generation circuit 140. In the shift clock generation circuit 140, the output signal of the RSFF 142 is set at a rising edge of the first demultiplex control signal Rsel. Therefore, the logic level of the shift clock signal ICPV becomes "H" (t1). In the shift clock generation circuit 140, the output signal of the RSFF 142 is reset at a rising edge of the third demultiplex control signal Bsel. Therefore, the shift clock signal ICPV which is changed to a logic level "L" at a rising edge of the third demultiplex control signal Bsel is output (t4). Other details are the same as the details of the timing chart shown in FIG. 6 or 10.

In this modification, since the shift clock signal can be generated in the display panel, the number of terminals can be reduced in the same manner as in the first modification.

The second demultiplex control signal Gsel may be input to the reset terminal R of the RSFF 142.

2. Second Embodiment

In the first embodiment, the shift clock signal is generated by the gate signal generation circuit 20 based on the demultiplex control signal. Therefore, the input terminal of the shift clock signal can be made unnecessary in the first embodiment. However, the present invention is not limited thereto.

In the second embodiment, the shift clock signal and the demultiplex control signal are generated by a gate signal generation circuit. This enables the number of input terminals of the display panel to be reduced in the case where the demultiplex control signal has a number of bits of two or more.

Figure 13:
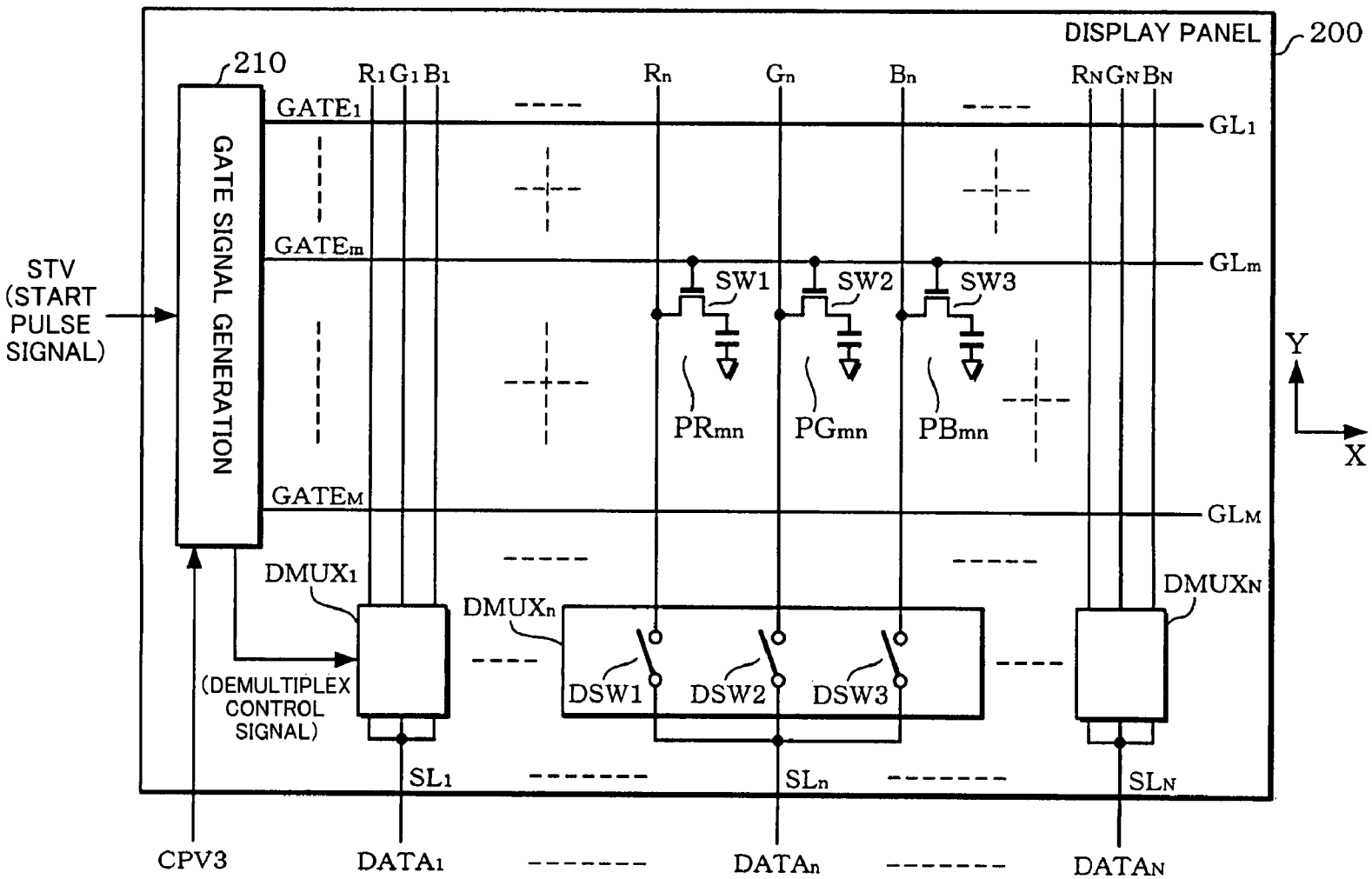
FIG. 13 is a diagram schematically showing the configuration of a display panel according to the second embodiment.

FIG. 13 schematically shows the configuration of a display panel according to the second embodiment. Note that components corresponding to those of the display panel 10 according to the first embodiment shown in FIG. 1 are denoted by the same reference numbers and further description thereof is omitted.

A display panel 200 in the second embodiment differs from the display panel 10 in the first embodiment in that the display panel 200 includes a gate signal generation circuit 210 instead of the gate signal generation circuit 20. The gate signal generation circuit 210 generates the gate signals $GATE_1$ to $GATE_M$ by shifting the start pulse signal STV in the same manner as the gate signal generation circuit 20. However, the gate signal generation circuit 210 is capable of generating the shift clock signal for generating the gate signals $GATE_1$ to $GATE_M$ and the demultiplex control signal based on a shift clock source signal (input shift clock signal) CPV3. The shift clock source signal CPV3 is a signal having a frequency three times the frequency of the shift clock signal ICPV shown in FIG. 4.

Figure 14:
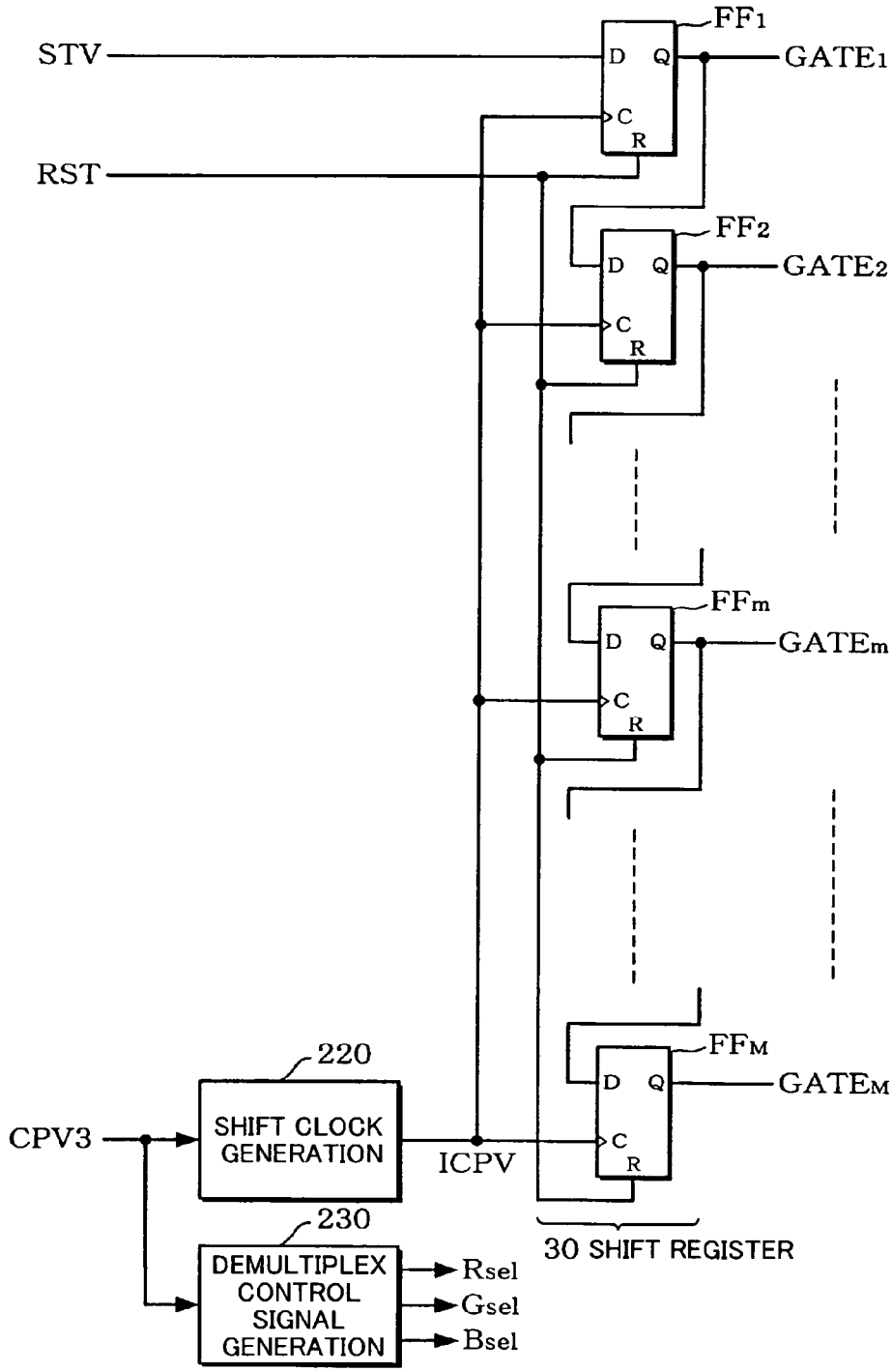
FIG. 14 is a circuit diagram showing the configuration of a gate signal generation circuit according to the second embodiment.

FIG. 14 shows the configuration of the gate signal generation circuit 210 in the second embodiment. Note that components corresponding to those of the gate signal generation circuit 20 shown in FIG. 4 are denoted by the same reference numbers and further description thereof is omitted. The gate signal generation circuit 210 includes the shift register 30, a shift clock generation circuit 220, and a demultiplex control signal generation circuit 230.

The shift clock generation circuit 220 generates the shift clock signal CPV based on the shift clock source signal CPV3. The shift clock generation circuit 220 is formed by a frequency divider circuit, for example. The frequency divider circuit outputs the shift clock signal ICPV having a frequency one third of the frequency of the shift clock source signal CPV3.

The demultiplex control signal generation circuit 230 generates the demultiplex control signal based on the shift clock source signal CPV3. The demultiplex control signal includes the first to third demultiplex control signals (Rsel, Gsel, Bsel). Therefore, the number of input terminals "3" of the demultiplex control signals (or the number of input terminals "2" in the case of encoding the demultiplex control signals) can be reduced to "1", which is the number of terminals necessary for the shift clock source signal CPV3.

Figure 15:
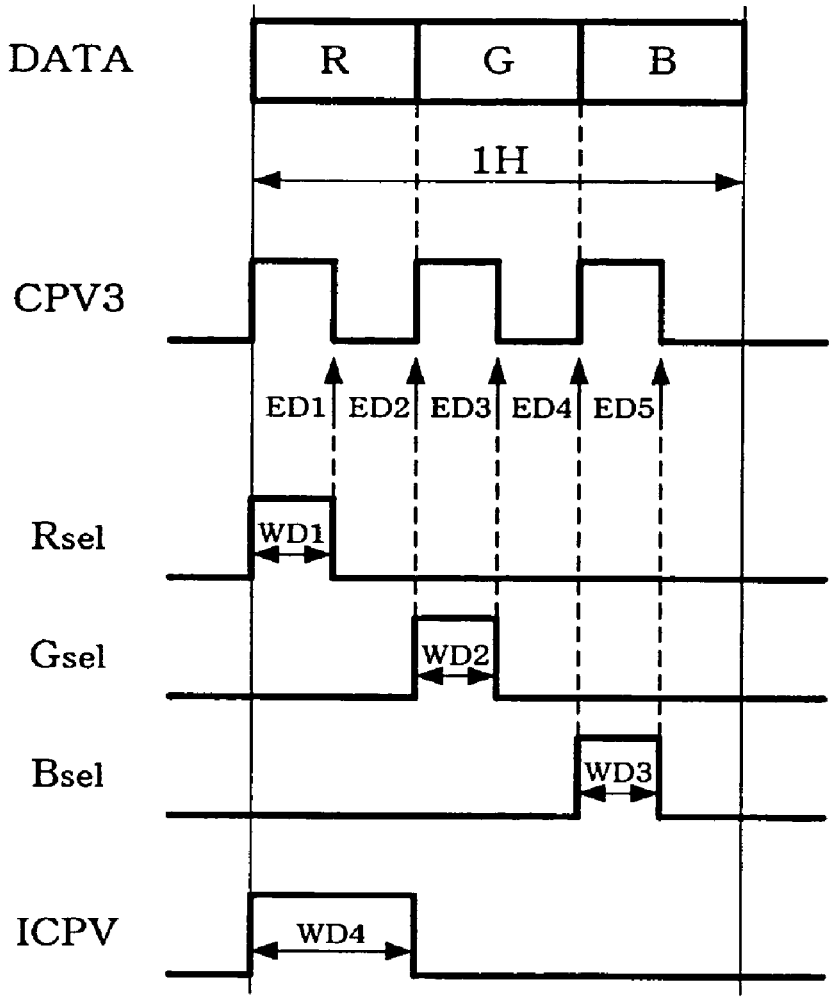
FIG. 15 is a diagram for illustrating an operation in the second embodiment.

FIG. 15 shows a diagram for illustrating an operation in the second embodiment. The shift clock source signal CPV3 having a frequency three times the frequency of the shift clock signal ICPV has three pulses within the 1H period in which the data signal DATA, in which the first to third color component signals are multiplexed, is output to each signal line. Therefore, five types of rising edges and falling edges ED1 to ED5 of the shift clock source signal CPV3 within the 1H period can be arbitrarily selected.

The logic level of the first demultiplex control signal Rsel is changed to "H" at a rising edge of the shift clock source signal CPV3 which specifies the 1H period, and the logic level of the first demultiplex control signal Rsel is changed to "L" at one of the edges ED1 to ED5 of the shift clock source signal CPV3.

The logic levels of the second and third demultiplex control signals Gsel and Bsel are changed to "H" or "L" at one of the edges ED1 to ED5 of the shift clock source signal CPV3.

This allows the first to third demultiplex control signals Rsel, Gsel, and Bsel to be generated as pulse signals having pulse widths WD1 to WD3 specified by the edges ED1 to ED5 of the shift clock source signal CPV3.

Each color component signal must be selectively output to the corresponding first to third color component signal lines in synchronization with the time-division timing. Therefore, the pulse signals of the first to third demultiplex control signals (Rsel, Gsel, Bsel) which exclusively go active in synchronization with the time-division timing must be generated.

The logic level of the shift clock signal ICPV may be changed to "H" or "L" at a rising edge of the shift clock source signal CPV3 which specifies the 1H period in the same manner as the first to third demultiplex control signals (Rsel, Gsel, Bsel). This enables a part of the generation circuit of the first to third demultiplex control signals (Rsel, Gsel, Bsel) to be shared, whereby the shift clock signal CPV3 having a pulse width WD4 can be generated without using the frequency divider circuit.

The shift clock generation circuit 220 and the demultiplex control signal generation circuit 230 are described below in detail.

Figure 16:
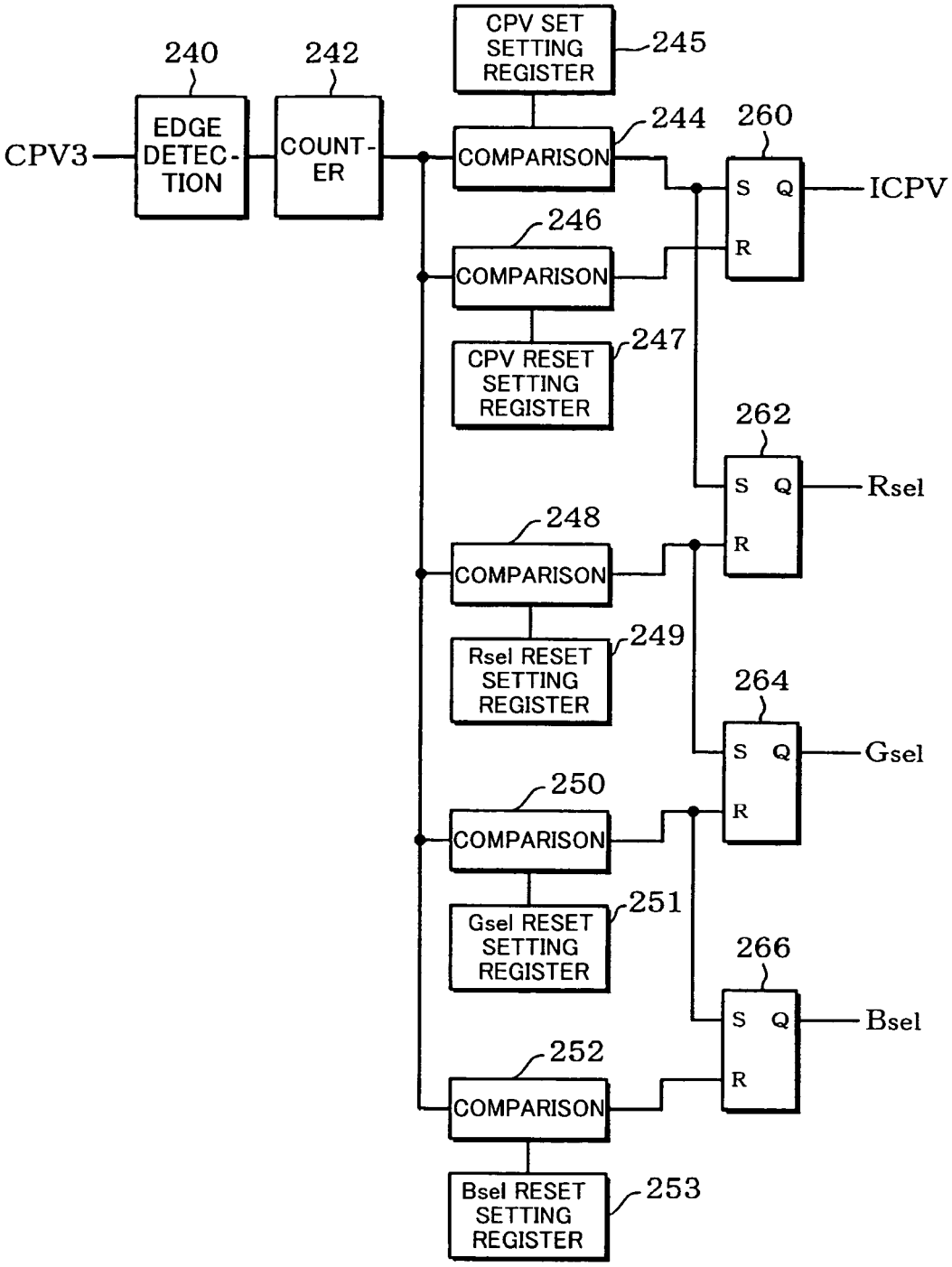
FIG. 16 is a circuit diagram showing the configuration of a shift clock generation circuit and a demultiplex control signal generation circuit according to the second embodiment.

FIG. 16 shows the configuration of the shift clock generation circuit 220 and the demultiplex control signal generation circuit 230. In FIG. 16, the pulse widths of the shift clock signal ICPV and the first to third demultiplex control signals Rsel, Gsel, and Bsel can be set by allowing the locations of the rising edge and the falling edge of the shift clock source signal CPV3 to be arbitrarily selected.

In FIG. 16, the circuit configuration is simplified by specifying the rising edges of the second and third demultiplex control signals (Gsel, Bsel) at the detection timing of the falling edges of the first and second demultiplex control signals (Rsel, Gsel).

An edge detection circuit 240 detects the edge of the shift clock source signal CPV3. In more detail, the edge detection circuit 240 includes a rising edge detection circuit and a falling edge detection circuit, and detects the rising edge and the falling edge of the shift clock source signal CPV3. The edge detection circuit 240 outputs a detection pulse when the edge detection circuit 240 detects the edge of the shift clock source signal CPV3.

A counter 242 is a 5 binary counter which counts the number of detection pulses output from the edge detection circuit 240. In more detail, the counter 242 starts counting from a counter value "0" in synchronization with the rising edge of the detection pulse, and sequentially increments the counter value in synchronization with the rising edge of the detection pulse. If the detection pulse is input when the counter value of the counter 242 is "5", the counter 242 resets the counter value to "0" and continues counting.

The counter values "1" to "5" of the counter 242 respectively correspond to the edges ED1 to ED5 of the shift clock source signal CPV3 shown in FIG. 15. Therefore, a signal having a pulse width which can be arbitrarily set can be generated by setting the signal to be controlled (changing the logic level from "L" to "H") or resetting the signal to be controlled (changing the logic level from "H" to "L") when the counter value output from the counter 242 coincides with a given set value.

A comparison circuit 244 generates set timing of the shift clock signal ICPV and the first demultiplex control signal Rsel. The comparison circuit 244 changes a comparison result signal to a logic level "H" if the counter value output from the counter 242 coincides with "0" retained in a CPV set setting register 245. The comparison result signal of the comparison circuit 244 is input to set terminals S of RSFF 260 and RSFF 262.

A comparison circuit 246 generates reset timing of the shift clock signal ICPV. The comparison circuit 246 changes a comparison result signal to a logic level "H" if the counter value output from the counter 242 coincides with a value retained in a CPV reset setting register 247. The comparison result signal of the comparison circuit 246 is input to a reset terminal R of the RSFF 260.

A comparison circuit 248 generates reset timing of the first demultiplex control signal Rsel. The comparison circuit 248 changes a comparison result signal to a logic level "H" if the counter value output from the counter 242 coincides with a value retained in a Rsel reset setting register 249. The comparison result signal of the comparison circuit 248 is input to a reset terminal R of the RSFF 262 and a set terminal S of RSFF 264.

A comparison circuit 250 generates reset timing of the second demultiplex control signal Gsel. The comparison circuit 250 changes a comparison result signal to a logic level "H" if the counter value output from the counter 242 coincides with a value retained in a Gsel reset setting register 251. The comparison result signal of the comparison circuit 250 is input to a reset terminal R of the RSFF 264 and a set terminal S of RSFF 266.

A comparison circuit 252 generates reset timing of the third demultiplex control signal Bsel. The comparison circuit 252 changes a comparison result signal to a logic level "H" if the counter value output from the counter 242 coincides with a value retained in a Bsel reset setting register 253. The comparison result signal of the comparison circuit 252 is input to a reset terminal R of the RSFF 264 and a set terminal S of RSFF 266.

Each of the RSFFs 260, 262, 264 and 266 includes a set terminal S, a reset terminal R, and an output terminal Q. Each RSFF sets the signal output from the output terminal Q to a logic level "H" when the logic level of the signal input to the set terminal S is "H". Each RSFF resets the signal output from the output terminal Q to a logic level "L" when the logic level of the signal input to the reset terminal R is "H".

The shift clock signal ICPV is output from the output terminal Q of the RSFF 260. The first demultiplex control signal Rsel is output from the output terminal Q of the RSFF 262. The second demultiplex control signal Gsel is output from the output terminal Q of the RSFF 264. The third demultiplex control signal Bsel is output from the output terminal Q of the RSFF 266.

Figure 17:
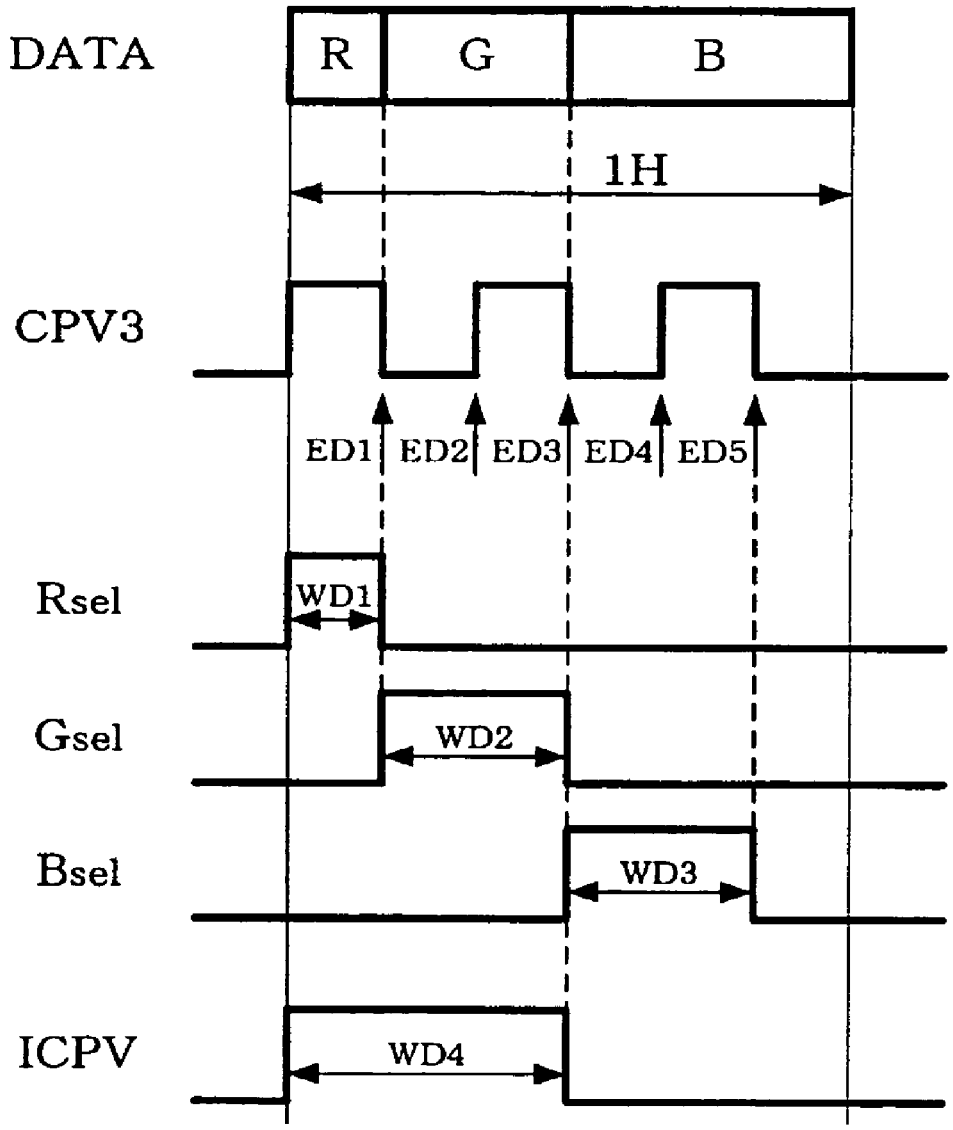
FIG. 17 is a timing chart showing an operation of the shift clock generation circuit and the demultiplex control signal generation circuit according to the second embodiment.

FIG. 17 shows a timing chart of an operation of the shift clock generation circuit 220 and the demultiplex control signal generation circuit 230 shown in FIG. 16.

A set value "3" corresponding to the edge ED3 of the shift clock source signal CPV3 is set in the CPV reset setting register 247. A set value "1" corresponding to the edge ED1 of the shift clock source signal CPV3 is set in the Rsel reset setting register 249. The set value "3" corresponding to the edge ED3 of the shift clock source signal CPV3 is set in the Gsel reset setting register 251. A set value "5" corresponding to the edge ED5 of the shift clock source signal CPV3 is set in the Bsel reset setting register 253.

Therefore, as shown in FIG. 17, the shift clock signal ICPV and the first to third demultiplex control signals Rsel, Gsel, and Bsel of which the pulse widths can be arbitrarily controlled can be generated based on the shift clock source signal CPV3.

In the second embodiment, the shift clock source signal having a frequency three times the frequency of the shift clock signal which shifts the gate signal is input to the display panel, and the shift clock signal and the first to third demultiplex control signals are generated in the display panel based on the shift clock source signal. This enables the number of input terminals of the first to third demultiplex control signals and the shift clock signal to be reduced in the display panel on which the TFT is formed by using LTPS while providing the conventional function without causing the image quality to deteriorate.

The present invention is not limited to the above-described embodiments. Various modifications are possible within the scope of the invention.

The above-described embodiments illustrate the case where the pixels are selected in units of three pixels corresponding to each color component of R, G, and B. However, the present invention is not limited thereto. For example, the present invention can also be applied to the case where the pixels are selected in units of one, two, or four or more pixels.

The order in which the first to third demultiplex control signals (Rsel, Gsel, Bsel) cyclically go active is not limited to that in the above embodiments.

Part of requirements of any claim of the present invention could be omitted from a dependent claim which depends on that claim. Moreover, part of requirements of any independent claim of the present invention could be made to depend on any other independent claim.

Moreover, following features can be disclosed relating to the above-described embodiments.

According to one embodiment of the present invention, there is provided a driver circuit for driving an electro-optical device which has:

a plurality of pixels;

a plurality of scanning lines;

a plurality of signal lines through each of which a multiplexed data signal for first to third color components is transmitted; and a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels, the driver circuit comprising:

a gate signal generation circuit which generates a gate signal output to one of the scanning lines by using the first to third demultiplex control signals, wherein the gate signal generation circuit also generates a shift clock signal based on the first to third demultiplex control signals, shifts a start pulse signal based on the shift clock signal to obtain a shift output, and outputs a signal corresponding to the shift output to one of the scanning lines.

In this driver circuit, the data signals for color components time-divided and output to the signal lines are selectively output to color component signal lines by using the first to third demultiplex control signals. Therefore, the select period of the pixels connected to the scanning lines can be specified by the first to third demultiplex control signals. Therefore, a shift clock signal is generated based on the first to third demultiplex control signals, a start pulse signal is shifted based on the shift clock signal to obtain a shift output, and a signal corresponding to the shift output is output to the scanning lines. This eliminates the need to supply the shift clock signal from the outside, whereby the input terminal of the shift clock signal can be made unnecessary without reducing the functions (or without causing the image quality to deteriorate). As a result, reduction of cost and power consumption can be achieved.

In this driver circuit, the first, second, and third demultiplex control signals may cyclically go active in this order; and the gate signal generation circuit may include: a falling edge detection circuit which detects a falling edge of the second or third demultiplex control signal; and a T flip-flop which outputs the shift clock signal which is inverted based on the first demultiplex control signal or a signal output from the falling edge detection circuit.

In this driver circuit, the first, second, and third demultiplex control signals go active in this order in the select period of the pixels connected to the scanning lines. Therefore, a shift clock signal having the select period as a cycle can be easily generated by allowing a rising edge of the first demultiplex control signal and a falling edge of the second or third demultiplex control signal to be input to the T flip-flop. Therefore, the gate signal generation circuit can be formed by using the LTPS process. Therefore, power consumption and the size and weight of a display panel can be reduced by forming the gate signal generation circuit and the display panel on a single substrate.

In this driver circuit, the first, second, and third demultiplex control signals may cyclically go active in this order; and the gate signal generation circuit may include an RS flip-flop which outputs the shift clock signal set by the first demultiplex control signal and reset by the second or third demultiplex control signal.

According to this driver circuit, since the gate signal generation circuit can be formed of the RS flip-flop, the circuit scale can be reduced while achieving the above-described effects.

According to another embodiment of the present invention, there is provided a driver circuit for driving an electro-optical device which has:

a plurality of pixels;

a plurality of scanning lines;

a plurality of signal lines through each of which a multiplexed data signal for first to third color components is transmitted; and a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels, the driver circuit comprising:

a gate signal generation circuit which generates a shift clock signal based on an input shift clock signal, shifts a start pulse signal based on the shift clock signal to obtain a shift output, and outputs a signal corresponding to the shift output to one of the scanning lines, wherein the gate signal generation circuit includes:

a shift clock generation circuit which generates the shift clock signal by dividing a frequency of the input shift clock signal into three; and a demultiplex control signal generation circuit which generates the first to third demultiplex control signals according to the multiplex timing of the data signals for the first to third color components based on the input shift clock signal.

In this driver circuit, the shift clock signal is obtained by dividing the frequency of the input shift clock signal into three. This means that the frequency of the input shift clock signal is three times greater than the frequency of the shift clock signal. Therefore, the input shift clock signal or a signal generated by using the input shift clock signal has a larger amount of edge information than the shift clock signal. The first to third demultiplex control signals for selectively outputting the data signals for color components are generated by using the input shift clock signal in synchronization with the multiplex timing of the data signals for the first to third color components. This makes it unnecessary to supply the first to third demultiplex control signals, for which at least two bits are necessary, from the outside, although the input terminal of the input shift clock signal must be provided. As a result, the number of terminals can be reduced without reducing the functions (or without causing the image quality to deteriorate).

The driver circuit may further comprise first to third pulse width setting registers, wherein the demultiplex control signal generation circuit may include: an edge detection circuit which detects a rising edge and a falling edge of the input shift clock signal; and a counter which counts the edges of the input shift clock signal based on an output signal of the edge detection circuit; and wherein the first to third demultiplex control signals may have a pulse width determined based on a comparison result of the output of the counter and set values of the first to third pulse width setting registers.

According to this driver circuit, the edge of the input shift clock signal can be arbitrarily selected, and the pulse widths of the first to third demultiplex control signals are set by using the edge of the input shift clock signal. Therefore, power consumption can be reduced by reducing the number of terminals, making it possible to flexibly deal with gray-scale characteristics of the display panel.

According to a further embodiment of the present invention, there is provided an electro-optical device comprising:

a plurality of pixels;

a plurality of scanning lines;

a plurality of signal lines through each of which a multiplexed data signal for first to third color components is transmitted;

a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels; and a gate signal generation circuit which generates a gate signal output to one of the scanning lines by using the first to third demultiplex control signals, wherein the gate signal generation circuit also generates a shift clock signal based on the first to third demultiplex control signals, shifts a start pulse signal based on the shift clock signal to obtain a shift output, and outputs a signal corresponding to the shift output to one of the scanning lines.

In this electro-optical device, the first, second, and third demultiplex control signals may cyclically go active in this order; and the gate signal generation circuit may include: a falling edge detection circuit which detects a falling edge of the second or third demultiplex control signal; and a T flip-flop which outputs the shift clock signal which is inverted based on the first demultiplex control signal or a signal output from the falling edge detection circuit.

In this electro-optical device, the first, second, and third demultiplex control signals may cyclically go active in this order; and the gate signal generation circuit includes an RS flip-flop which outputs the shift clock signal set by the first demultiplex control signal and reset by the second or third demultiplex control signal.

According to still another embodiment of the present invention, there is provided an electro-optical device comprising:

a plurality of pixels;

a plurality of scanning lines;

a plurality of signal lines through each of which a multiplexed data signal for first to third color components is transmitted;

a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels; and a gate signal generation circuit which generates a shift clock signal based on an input shift clock signal, shifts a start pulse signal based on the shift clock signal to obtain a shift output, and outputs a signal corresponding to the shift output to one of the scanning lines, wherein the gate signal generation circuit includes:

a shift clock generation circuit which generates the shift clock signal by dividing a frequency of the input shift clock signal into three; and a demultiplex control signal generation circuit which generates the first to third demultiplex control signals according to the multiplex timing of the data signals for the first to third color components based on the input shift clock signal.

The electro-optical device may further comprise first to third pulse width setting registers, wherein the demultiplex control signal generation circuit may include: an edge detection circuit which detects a rising edge and a falling edge of the input shift clock signal; and a counter which counts the edges of the input shift clock signal based on an output signal of the edge detection circuit; and wherein the first to third demultiplex control signals may have a pulse width determined based on a comparison result of the output of the counter and set values of the first to third pulse width setting registers.

According to yet another embodiment of the present invention, there is provided a method of driving an electro-optical device which has:

a plurality of pixels;

a plurality of scanning lines;

a plurality of signal lines through each of which a multiplexed data signal for first to third color components is transmitted; and a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels, the method comprising:

generating a shift clock signal based on the first to third demultiplex control signals; and outputting a signal corresponding to a shift output to one of the scanning lines, the shift output being obtained by shifting a start pulse signal based on the shift clock signal.

According to still a further embodiment of the present invention, there is provided a method of driving an electro-optical device which has:

a plurality of pixels;

a plurality of scanning lines;

a plurality of signal lines through each of which a multiplexed data signal for first to third color components is transmitted; and a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels, the method comprising:

generating the first to third demultiplex control signals according to the multiplex timing of the data signals for the first to third color components based on an input shift clock signal, and generating a shift clock signal by dividing a frequency of the input shift clock signal into three; and outputting a signal corresponding to a shift output to one of the scanning lines, the shift output being obtained by shifting a start pulse signal based on the shift clock signal.

What is claimed is:

1. A driver circuit for driving an electro-optical device which has:

a plurality of pixels;

a plurality of scanning lines;

a plurality of signal lines through each of which a multiplexed data signal for first to third color components is transmitted; and a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels, the driver circuit comprising:

a gate signal generation circuit which generates a gate signal output to one of the scanning lines by using the first to third demultiplex control signals, wherein the gate signal generation circuit also generates a shift clock signal based on the first to third demultiplex control signals, shifts a start pulse signal based on the shift clock signal to obtain a shift output, and outputs a signal corresponding to the shift output to one of the scanning lines.

2. The driver circuit as defined in claim 1, wherein the first, second, and third demultiplex control signals cyclically go active in this order; and wherein the gate signal generation circuit includes:

a falling edge detection circuit which detects a falling edge of the second or third demultiplex control signal; and a T flip-flop which outputs the shift clock signal which is inverted based on the first demultiplex control signal or a signal output from the falling edge detection circuit.

3. The driver circuit as defined in claim 1, wherein the first, second, and third demultiplex control signals cyclically go active in this order; and wherein the gate signal generation circuit includes an RS flip-flop which outputs the shift clock signal set by the first demultiplex control signal and reset by the second or third demultiplex control signal.

4. A driver circuit for driving an electro-optical device which has:

a plurality of pixels;

a plurality of scanning lines;

a plurality of signal lines through each of which a multiplexed data signal for first to third color components is transmitted; and a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels, the driver circuit comprising:

a gate signal generation circuit which generates a shift clock signal based on an input shift clock signal, shifts a start pulse signal based on the shift clock signal to obtain a shift output, and outputs a signal corresponding to the shift output to one of the scanning lines, wherein the gate signal generation circuit includes:

a shift clock generation circuit which generates the shift clock signal by dividing a frequency of the input shift clock signal into three; and a demultiplex control signal generation circuit which generates the first to third demultiplex control signals according to the multiplex timing of the data signals for the first to third color components based on the input shift clock signal.

5. The driver circuit as defined in claim 4, further comprising:

first to third pulse width setting registers, wherein the demultiplex control signal generation circuit includes:

an edge detection circuit which detects a rising edge and a falling edge of the input shift clock signal; and a counter which counts the edges of the input shift clock signal based on an output signal of the edge detection circuit; and wherein the first to third demultiplex control signals have a pulse width determined based on a comparison result of the output of the counter and set values of the first to third pulse width setting registers.

6. An electro-optical device comprising:

a plurality of pixels;

a plurality of scanning lines;

a plurality of signal lines through each of which a multiplexed data signal for first to third color components is transmitted;

a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels; and a gate signal generation circuit which generates a gate signal output to one of the scanning lines by using the first to third demultiplex control signals, wherein the gate signal generation circuit also generates a shift clock signal based on the first to third demultiplex control signals, shifts a start pulse signal based on the shift clock signal to obtain a shift output, and outputs a signal corresponding to the shift output to one of the scanning lines.

7. The electro-optical device as defined in claim 6, wherein the first, second, and third demultiplex control signals cyclically go active in this order; and wherein the gate signal generation circuit includes:

a falling edge detection circuit which detects a falling edge of the second or third demultiplex control signal; and a T flip-flop which outputs the shift clock signal which is inverted based on the first demultiplex control signal or a signal output from the falling edge detection circuit.

8. The electro-optical device as defined in claim 6, wherein the first, second, and third demultiplex control signals cyclically go active in this order; and wherein the gate signal generation circuit includes an RS flip-flop which outputs the shift clock signal set by the first demultiplex control signal and reset by the second or third demultiplex control signal.

9. An electro-optical device comprising:

a plurality of pixels;

a plurality of scanning lines;

a plurality of signal lines through each of which a multiplexed data signal for first to third color components is transmitted;

a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels; and a gate signal generation circuit which generates a shift clock signal based on an input shift clock signal, shifts a start pulse signal based on the shift clock signal to obtain a shift output, and outputs a signal corresponding to the shift output to one of the scanning lines, wherein the gate signal generation circuit includes:

a shift clock generation circuit which generates the shift clock signal by dividing a frequency of the input shift clock signal into three; and a demultiplex control signal generation circuit which generates the first to third demultiplex control signals according to the multiplex timing of the data signals for the first to third color components based on the input shift clock signal.

10. The electro-optical device as defined in claim 9, further comprising:

first to third pulse width setting registers, wherein the demultiplex control signal generation circuit includes:

an edge detection circuit which detects a rising edge and a falling edge of the input shift clock signal; and a counter which counts the edges of the input shift clock signal based on an output signal of the edge detection circuit; and wherein the first to third demultiplex control signals have a pulse width determined based on a comparison result of the output of the counter and set values of the first to third pulse width setting registers.

11. A method of driving an electro-optical device which has:

a plurality of pixels;

a plurality of scanning lines;

a plurality of signal lines through each of which a multiplexed data signal for first to third color components is transmitted; and a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels, the method comprising:

generating a shift clock signal based on the first to third demultiplex control signals; and outputting a signal corresponding to a shift output to one of the scanning lines, the shift output being obtained by shifting a start pulse signal based on the shift clock signal.

12. A method of driving an electro-optical device which has:

a plurality of pixels;

a plurality of scanning lines;

a plurality of signal lines through each of which a multiplexed data signal for first to third color components is transmitted; and a plurality of demultiplexers, each of which includes first to third demultiplexing switch elements respectively controlled by first to third demultiplex control signals, one end of each of the demultiplexing switch elements being connected to one of the signal lines and the other end of each of the demultiplexing switch elements being connected to a pixel for the j-th color component ($1 \leqq j \leqq 3$, j is an integer) among the plurality of pixels, the method comprising:

generating the first to third demultiplex control signals according to the multiplex timing of the data signals for the first to third color components based on an input shift clock signal, and generating a shift clock signal by dividing a frequency of the input shift clock signal into three; and outputting a signal corresponding to a shift output to one of the scanning lines, the shift output being obtained by shifting a start pulse signal based on the shift clock signal.

* * * * *